US007884291B2

(12) United States Patent
Terao

(10) Patent No.: US 7,884,291 B2
(45) Date of Patent: Feb. 8, 2011

(54) SWITCH APPARATUS

(75) Inventor: Takanori Terao, Tsurugashima (JP)

(73) Assignee: Toyo Denso Kabushiki Kaisha, Tsurugashima-shi, Saitama (JP)

( * ) Notice: Subject to any disclaimer, the term of this patent is extended or adjusted under 35 U.S.C. 154(b) by 179 days.

(21) Appl. No.: 12/187,676

(22) Filed: Aug. 7, 2008

(65) Prior Publication Data

US 2009/0038929 A1 Feb. 12, 2009

(30) Foreign Application Priority Data

Aug. 10, 2007 (JP) ..... 2007-210431
Aug. 1, 2008 (JP) ..... 2008-200222

(51) Int. Cl.
*H01H 19/00* (2006.01)

(52) U.S. Cl. ..... 200/6 A; 200/339

(58) Field of Classification Search ..... 200/6 A
See application file for complete search history.

(56) References Cited

U.S. PATENT DOCUMENTS 5,568,367 A * 10/1996 Park ..... 362/109
5,619,195 A * 4/1997 Allen et al. ..... 341/20
7,193,166 B2 * 3/2007 Sakurai et al. ..... 200/5 R
7,350,285 B2 * 4/2008 Mitsuoka et al. ..... 200/516

FOREIGN PATENT DOCUMENTS

JP 5-5629 2/1993
JP 2001-229785 8/2001

* cited by examiner

*Primary Examiner*—Renee S Luebke
*Assistant Examiner*—Lisa Klaus
(74) *Attorney, Agent, or Firm*—Rankin, Hill & Clark LLP

(57) ABSTRACT

A pair of engaging projections is provided on a periphery of a knob mounting section projecting from an upper case 13. A substantially octagonal annular joint member is engaged with the engaging projections and has a pair of engaging projections provided in the direction of 90 degrees off the engaging projections so as to be relatively rockably engaged with the operation knob, whereby the operation knob is universally jointed through the joint member with the knob mounting section. The operation knob is capable of being rocked by pressing an optional position thereof in the circumferential direction, and by being pivoted on two axes meeting at right angles, properly controlled steady operation can be performed. A seal plate is placed on a concave portion of the upper case. Lift springs are projectingly formed on the seal plate at intervals of about 45 degrees in the circumferential direction. When pressing the optional position in the circumferential direction of the operation knob, any of the lift springs is compressed such that a switch element located below the lift springs is turned on or off.

6 Claims, 19 Drawing Sheets

Fig. 17

| Press point | Switch element | | | Motor operating direction |
|---|---|---|---|---|
| | a | b | c | |
| P1 | | | ○ | Upward |
| P2 | | | ○ | Upward |
| P3 | ○ | | | Right |
| P4 | ○ | | | Right |
| P5 | ○ | ○ | | Downward |
| P6 | | ○ | | Left & Downward |
| P7 | | ○ | ○ | Left |
| P8 | | | ○ | Upward |

SWITCH APPARATUS

BACKGROUND OF THE INVENTION

1. Field of the Invention

The present invention relates to a switch apparatus suitable for an operation of an electric mirror or the like of a motor vehicle.

2. Description of the Related Art

There is known a switch apparatus for an electric mirror that an operation knob is mounted on a switch case so as to be rocked about in an optional direction relative to the switch case. In the known switch apparatus, for example, press points corresponding to each of upward, downward, right and left adjustment directions are provided at intervals of 90 degrees on a peripheral edge portion of the operation knob. When any one of press points is selectively pressed, a mirror tilting motor constituted by two motors for upward and downward adjustment and for right and left adjustment is rotated in a normal direction or in a reverse direction so as to adjust the tilt of the mirror. In addition, there is another apparatus that the press points are provided at intervals of 45 degrees to be adjustable also in the case of pressing the press points of diagonal positions.

Patent reference 1: Japanese utility model publication No. H05-5629.

Patent reference 2: Japanese patent No. 3,766,251.

The brief construction of the switch apparatus as described above is shown in FIG. 20 and FIG. 21. FIG. 20 is an exploded view of an essential part, in which four mounting legs 2 (see FIG. 21) project from an inside wall of a substantially square operation knob 1. The mounting legs 2 are fitted into a mounting hole 4 provided in the switch case 3, and hooks 2*a* provided on distal ends thereof are engaged with a flange 4*b* of a peripheral wall 4*a* provided in the periphery of the mounting hole 4, whereby the operation knob 1 is mounted on the mounting leg 2.

Between the operation knob land the mounting legs 2 there is interposed a rubber spring 5, and eight lift springs 5*a* are formed integrally at intervals of 45 degrees in a projecting fashion so as to lift and support the operation knob 1 in such a manner that each tip of the lift springs 5*a* supports the bottom of the peripheral portion of the operation knob 1. These supporting points correspond to press points P1~P8 set substantially at intervals of 45 degrees on a peripheral edge of the operation knob 1. When any one of the press points is pressed, a total of three corresponding lift spring 5*a* and neighboring lift springs on both sides thereof are compressed and elastically deformed at the same time to tilt the operation knob 1, while, when releasing the press of the operation knob 1, the lift springs 5*a* return to the original state to restore the tilt of the operation knob 1 to the original state.

Actuator rods 6 are housed in the three lift springs among eight lift springs 5*a* and inserted at the lower ends thereof through bores 3*a* formed in an upper wall of the switch case 3, into the switch case 3 thereby abutting on inclined walls 7*a* of sliders 7. The sliders 7 are provided three correspondingly to the actuator rods 6 and each have movable contacts 8. The sliders 7 are slidable on a circuit board 9 in opposition to return springs 7*b*. When the slider 7 moves in opposition to the return spring 7*b* by pressing down the actuator rod 6, the movable contact 8 comes into contact with a fixing contact 9*a* on the circuit board 9 so as to turn the switch on. When releasing the pressing of the actuator rod 6, the slider 7 is returned to the original position by the return spring 7*b* so as to turn the switch off.

A switch element is comprised of the actuator rod 6, the slider 7, the movable contact 8, the return spring 7*b* and the fixed contact 9*a*. The normal and reverse rotation of the upward and downward adjustment motor and the normal and reverse rotation of the right and left adjustment motor are capable of being controlled by the combination of a switching-on operation and a switching-off operation of three switch elements. Only three switch elements are sufficient for eight lift springs 5*a* whereby it is possible to reduce the number of the switch element relative to the lift spring 5*a*.

FIG. 21 is a schematic view of an operation state of the operation knob 1. FIG. 21-A is a neutral state, FIG. 21-B is a pressing state of the operation knob 1 still in progress, and FIG. 21-C is a sufficiently pressed state. As shown in the phantom line in FIG. 21-A, when the center of the operation knob 1 is pressed, the whole operation knob 1 goes downward, so that all the switch elements are turned on to keep the neutral state. When one of the press points (P7 in this embodiment) is pressed, the mounting leg 2 close to this press point, as shown in FIG. 21-B, projects downward, and the operation knob 1 is tilted to the press point P7 by using the engaging portion between the mounting leg 2 on the opposite side thereof and the switch case 3 as a fulcrum, Then, the lift spring 5*a* is pressed by the neighboring portion of the press point P7. When completely pressed, the operation knob 1 comes to the state shown in FIG. 21-C. At this time, as shown in FIG. 21-C, the mounting leg 2 on the side of the fulcrum is slightly moved downward, depending upon the pressing condition.

In the conventional switch construction as above, the operation knob 1, when being pressed, moves in the upward and downward direction relative to the switch case 3. That is the same when the operation knob 1 is rocked. Accordingly, there is a possibility that a fluffy unsteady feeling is created in the operation of the operation knob 1, and there are cases that a more positively controlled steady operation is desired rather than an operation of the fluffy unsteady feeling, whereby the construction realizing the desire is required.

Further, as shown in FIG. 20, when any one of the press points P1~P8 corresponding to eight lift springs 5*a* is pressed, the lift spring corresponding to the pressed press point and neighboring two lift springs are pressed at the same time. Then, if three switch elements are provided for P4, P6 and P8, and when any of these press points other than the press point 2 is pressed, any of the switch elements is switched to have the mirror adjustment motor operated in response thereto. However, when the press point P2 is pressed, none of the switch elements are arranged correspondingly to the press points P1~P3, so that the mirror adjustment motor is not operated in response thereto. Therefore, since there is a possibility of being recognized as a malfunction in case of no response to the operation of the operation knob 1, it is also required to solve such situation as above. The present invention is intended to solve such problems.

SUMMARY OF THE INVENTION

To solve the above mentioned problems, a switch apparatus in accordance with a first aspect of the present invention comprises a switch case being provided with a circuit board, an operation knob being mounted in a rockable fashion in an optional direction relative to the switch case, a plurality of lift springs being arranged along a peripheral edge of the operation knob between the operation knob and the switch case so as to lift and support the operation knob on the side of the switch case and are selectively compressed by a rocking movement of the operation knob, and a plurality of switch elements being smaller in number than the lift springs arranged in locations corresponding to the lift springs and being provided on the circuit board, the switch elements being selectively pressed in accordance with the rocking direction of the operation knob, wherein a joint member in the shape of a ring is interposed between the operation knob and the switch case, the operation knob is so mounted on the joint member as to be rockable around a first axis of rocking movement, the joint member is so mounted on a knob mounting section projecting from the switch case as to be rockable around a second axis of rocking movement meeting at right angles with the first axis of rocking movement, in such a manner that the operation knob is mounted through the joint member on the switch case in a universal joint method.

In accordance with a second aspect of the present invention, the switch apparatus further comprises an interlocking press section, wherein when the lift spring to which the switch element is not arranged correspondingly is pressed by the operation knob, the interlocking press section is adapted to press the switch element arranged correspondingly to another lift spring.

In accordance with a third aspect of the present invention, the switch apparatus further comprises a first rocking pivot integrally projecting from the joint member on the first axis of rocking movement, wherein a distal end of the first rocking pivot is formed with a tapered wall for facilitating engagement between the first rocking pivot and the operation knob.

In accordance with a fourth aspect of the present invention, the switch apparatus further comprises a second rocking pivot integrally projecting from the knob mounting section of the switch case on the second axis of rocking movement, wherein a distal end of the second rocking pivot is formed with a tapered wall for facilitating engagement between the second rocking pivot and the joint member.

In accordance with a fifth aspect of the present invention, the knob mounting section is formed in the cylindrical shape, a light bulb for a transmitted light display on the operation knob is arranged within the inner space of the knob mounting section, said switch elements are provided in the switch case so as to surround the light bulb, and a photo conductive member is provided within the switch case by using a space in which the switch element is not arranged and conducts a light from the light bulb to a surrounding area.

According to the invention as defined in the first aspect, the operation knob is so mounted on the joint member as to be rockable around the first axis of rocking movement, and the joint member is so mounted on a knob mounting section of the switch case as to be rockable around the second axis of rocking movement meeting at right angles with the first axis of rocking movement, in such a manner that the operation knob is universally jointed through the joint member with the switch case. Therefore, the operation knob is able to be rocked in all the directions. Also, since the rocking movement is done around the engaging projections as the first and second rocking pivots, the properly controlled steady operation feeling can be obtained by removing the fluffy unsteady feeling, whereby the reliability of operation can be improved.

According to the invention as defined in the second aspect, when pressing the press point to which the switch element does not correspond, the joint member is operated together therewith and rocked by pressing this press point, whereby the interlocking press section can press the switch element to carry out switching. Therefore, no responsive operation such as no actuation of the motor at the time of operating the operation knob is avoided and the responsive operation can be surely carried out, whereby a misunderstanding of a malfunction or the like is not caused, so as to be capable of improving the reliability of operation.

According to the invention as defined in the third aspect, since an engaging projection constituting the first rocking pivot along the first axis of rocking movement is provided on the joint member, the joint member can be easily engaged integrally with the operation knob. In addition, since the distal end of the engaging projection is formed with a tapered wall, the engagement can be further facilitated.

According to the invention as defined in the fourth aspect, since an engaging projection constituting the second rocking pivot along the second axis of rocking movement is provided on the knob mounting section, the joint member can be easily engaged integrally with the knob mounting section. In addition, since the distal end of the engaging projection is formed with the tapered wall, the engagement can be further facilitated.

According to the invention as defined in the fifth aspect, since the light bulb is housed in the inner space of the knob mounting section, the transmitted light display on the operation knob is easily done. Moreover, since the bulb is located in a center position and a small number of switch elements are arranged around the bulb, the photo conductive member for conducting the light of the bulb from the center to the peripheral area of the switch case can be efficiently arranged by using a space in which the switch element is not arranged.

BRIEF DESCRIPTION OF THE DRAWINGS

FIG. 17 is a table of switching operations between the operation knob and the switch element;

DETAILED DESCRIPTION OF THE PREFERRED EMBODIMENT

Figure 1:
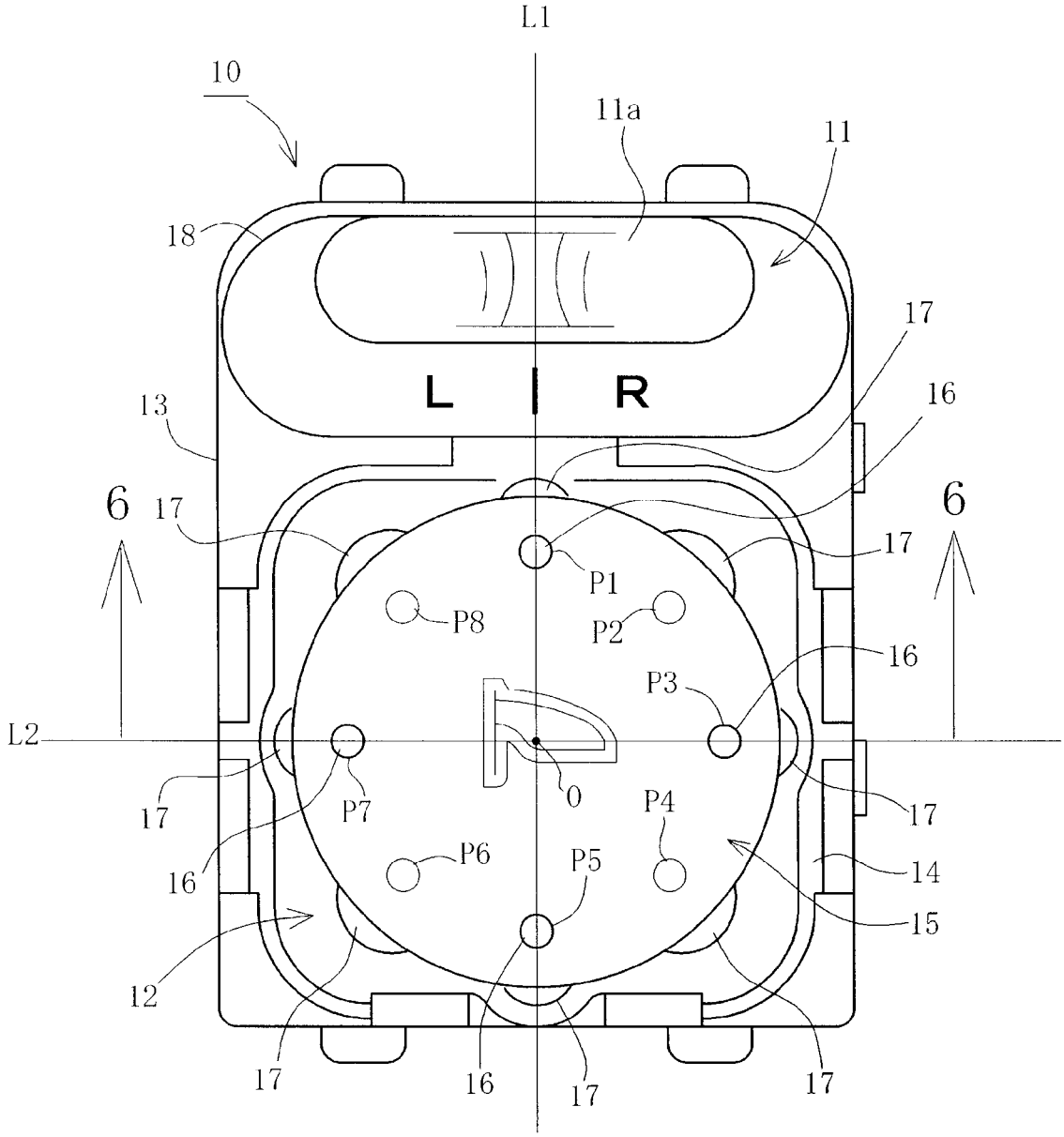
FIG. 1 is a plan view of a mirror switch according to a first embodiment of the present invention.
Figure 2:
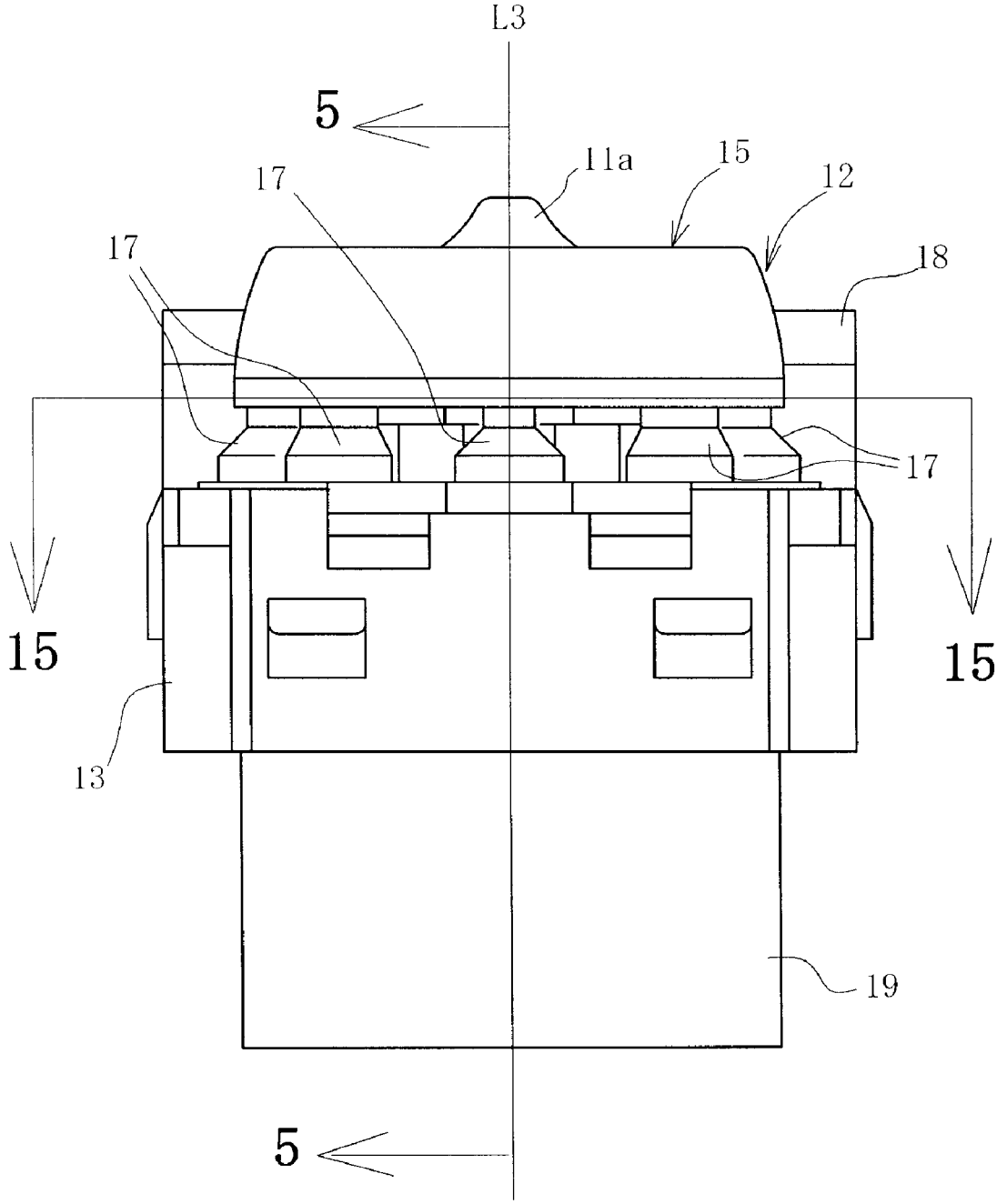
FIG. 2 a front view thereof.

Hereinafter, an embodiment of a mirror switch for operating an electric mirror for a motor vehicle will be explained with reference to the accompanying drawings. FIG. 1 is a plan view and FIG. 2 is a front view. This mirror switch 10 is a switch apparatus for controlling normal and reverse rotation of an upward and downward adjustment motor (not shown) and a right and left adjustment motor (not shown) provided for each of electric mirrors (not shown) located on a right and a left sides of a vehicle body. The mirror switch 10 has a slide switch 11 for selecting one of the right and left electric mirrors as a target of an operation, and a press switch 12 for carrying out the normal and reverse rotation control of the upward and downward adjustment motor or the right and left adjustment motor in order to adjust the tilt in either an upward and downward direction or a right and left direction for one of the right and left electric mirror selected by the slide switch 11.

The slide switch 11 is provided with a slide knob 11*a* which is able to slide on an upper case 13 in a right and left direction of FIG. 1. When letting the slide knob 11*a* slide to an L position located on the left side of FIG. 1, the target of operation is switched to the electric mirror located on the left side of the vehicle body. On the other hand, when letting the slide knob 11*a* slide to an R position on the right side, the target of operation is switched to the electric mirror on the right side of the vehicle body. The center is a neutral position. The upper case 13 forms a switch case together with a lower case as described later.

The press switch 12 is provided with a circular operation knob 15 which is arranged within a substantially square concave portion 14 on the upper case 13. Press points P1~P8 are provided at intervals of about 45 degrees on a peripheral edge portion of the operation knob 15. Among these press points, the press point P1 corresponds to an operation of the top of the mirror, the press point P3 corresponds to an operation of the right, the press point P5 corresponds to an operation of the bottom, and the press point P7 corresponds to an operation of the left. Also, a line passing the press points P1 and P5 is a first central axis L1 of rocking movement, while a line passing the press points P3 and P7 is a second central axis L2 of rocking movement. Marking projections 16 are projectingly formed on the locations of the press points P1, P3, P5 and P7.

Eight lift springs 17 are arranged between the operation knob 15 and the press switch 12. These lift springs 17 are provided on the locations corresponding to the press points P1~P8. A line L3 (FIG. 2) passes an intersection point O (FIG. 1) of two axes L1 and L2 meeting at right angles on the same plane with an upper surface of the operation knob 15 and meets at right angles with the axes L1 and L2. The line L3 shows the pressing direction when the center of the operation knob 15 is pressed vertically downward.

The slide switch 11 is provided on a step section 18 being formed on the side of an end of the upper case 13 and being raised one step above the concave portion 14 on which the press switch 12 is mounted. The lower case as described later is fitted into the inside of the upper case 13, and a coupler 19 projects downward from the lower case.

Figure 3:
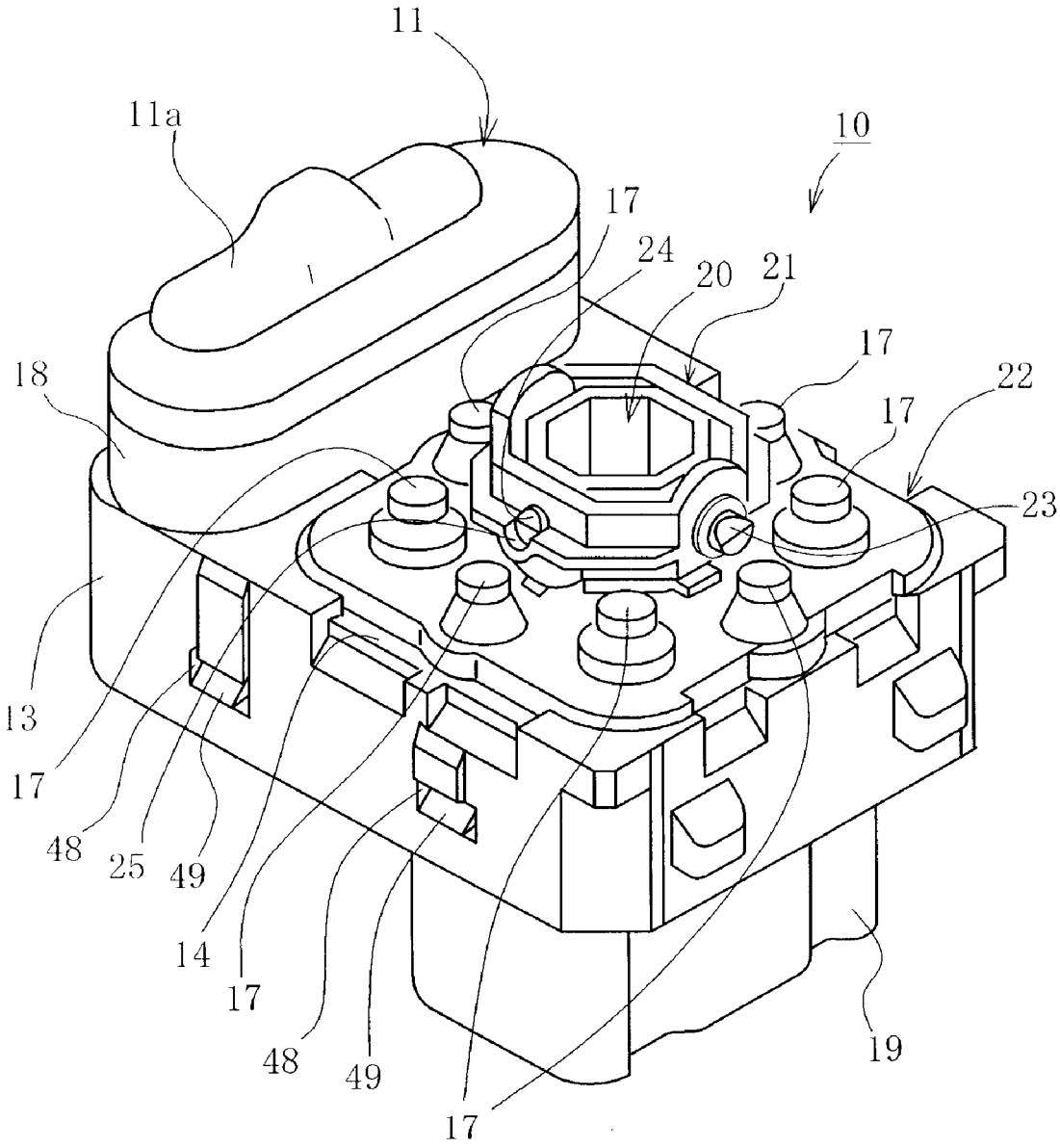
FIG. 3 is a perspective view of the mirror switch form which an operation knob is taken away.
Figure 4:
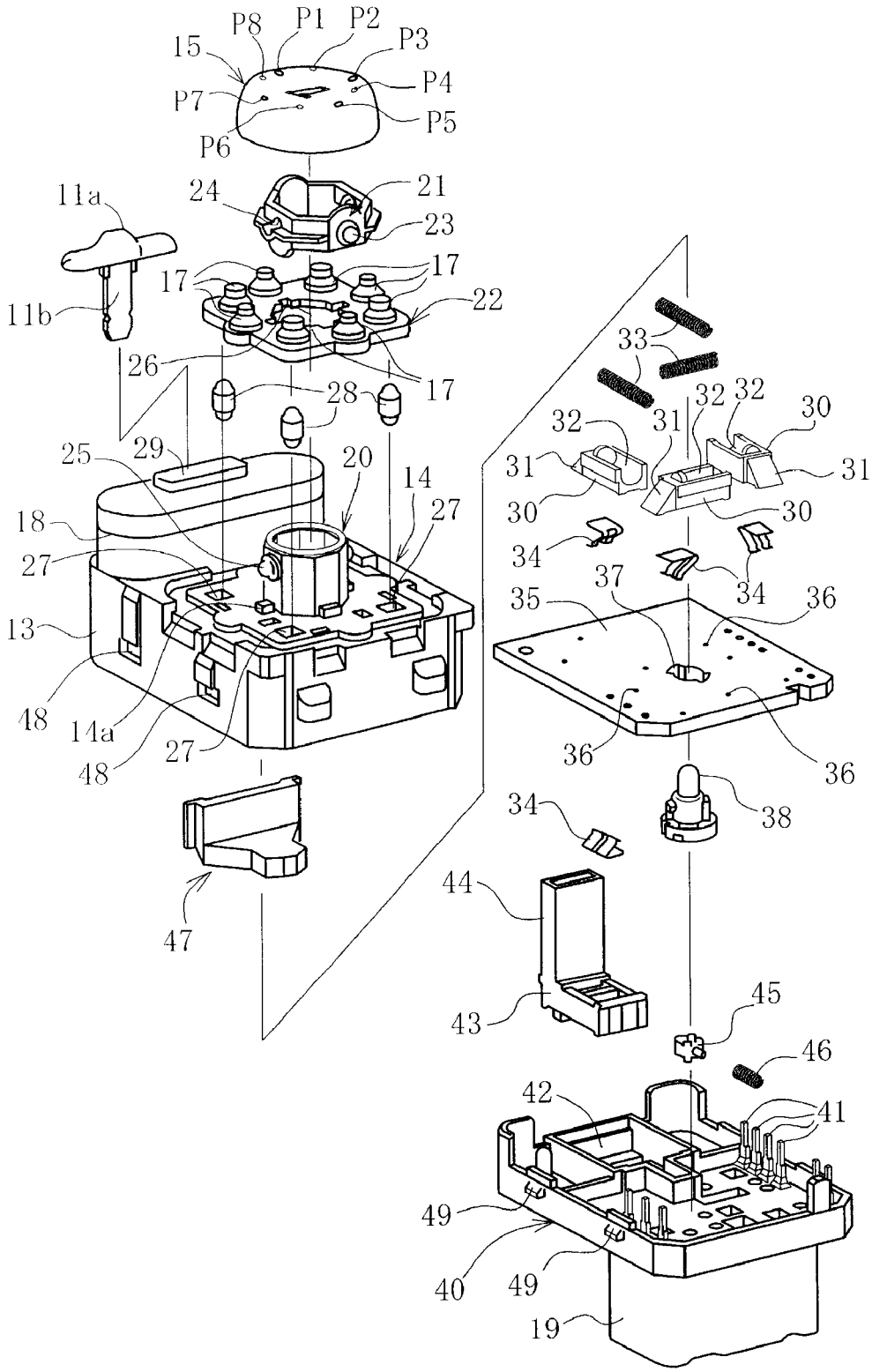
FIG. 4 is an exploded perspective view of the whole mirror switch.

FIG. 3 is a perspective view of the mirror switch 10 from which the operation knob 15 is taken away and FIG. 4 is an exploded perspective view of the whole mirror switch 10. As shown in FIG. 3, a knob mounting section 20 projects integrally upward from the center of the concave portion 14 and is formed in the shape of a substantially octagonal pipe. A substantially octagonal ring-shaped joint member 21 is mounted on a periphery of the knob mounting section 20 with a gap left between the joint member and the knob mounting section. The knob mounting section 20 and the joint member 21 are engaged with each other in a rockable fashion around the first central axis L1 of rocking movement (FIG. 1), as described later.

The concave portion 14 around the knob mounting section 20 is covered with a substantially square seal plate 22, and lift springs 17 are circumferentially provided on and integrally project from the seal plate 22. The seal plate 22 is made of rubber. The region other than the lift springs 17 is formed by a flat rubber plate and has a substantially same thickness as the step portion of the concave 14. The seal plate 22 functions as a seal for the inside of the upper case 13. By the way, the seal plate 22 may be formed also by another proper elastic material of synthetic resin which performs the seal function and the lift spring function of the lift springs 17.

The upper case 13 and the joint member 21 are each made of resin. The joint member 21 has an engaging projection 23 constituting a first rocking pivot, which integrally projects outwardly from one side of an octagon of the joint member 21. On the side of 90 degrees differing in a circumferential direction from the side of the engaging projection 23 there is provided an engaging hole 24 into which an engaging projection 25 constituting a second rocking pivot is engaged. The engaging projection 25 is projectingly provided on the knob mounting section 20. These engaging projection 23 and engaging hole 24 are provided each in pairs also on the opposite side at intervals of 180 degrees. Each pair of engaging projections 23 and 25 projects in opposite directions on an imaginary extension line across the central axis (i.e. L3, see FIG. 2) of the knob mounting section 20.

A shown in FIG. 4, the seal plate 22 has at the center thereof a central opening 26 through which the knob mounting section 20 passes. When the knob mounting section 20 passes through the central opening 26, a seat portion 14*a* formed around the knob mounting section 20 is covered with the seal plate 22. The seat portion 14*a* is formed slightly higher at the inward position of the concave portion 14 and has three through-holes 27 formed at three corners thereof. The locations of the three through-holes 27 correspond each to the press points P4, P6 and P8.

Lower ends of actuator rods 28 are inserted into these though-holes 27 respectively while upper ends thereof are previously housed in the insides of the lift springs 17 corresponding to the press points P4, P6 and P8, respectively. Each of lift springs 17 is pressed through the rocking movement of the operation knob 15 thereby to be compressed and elastically deformed. Then, the lift springs 17 in which the actuator rods 28 are housed push the actuator rods 28 downward at the same time when being compressed.

At the location corresponding to each of the actuator rods 28 within the upper case 13, each of three sliders 30 in total is arranged. Each of the slider 30 is provided at an end thereof with a slant wall 31 with which each of corresponding lower ends of the actuator rods 28 comes into contact. Each of the sliders 30 has a recessed portion 32 within which a return spring 33 is accommodated. The return spring 33 comes into contact at an end thereof with a wall adjacent to the slant wall 31 and at the other end thereof with the side of the upper case 13, so that the slant wall 31 is spring-biased in the direction that the actuator rod 28 is pushed up.

On the bottom wall of each of the sliders 30 there is provided a movable contact 34. Each of the sliders 30 is able to slide on a circuit board 35. The movable contact 34 slides and comes into contact with a fixed contact 36 correspondingly provided on the circuit board 35, so as to switch the contact connection on and off. In this embodiment, all the contacts are normally opened, while they are closed only when the slider 30 moves in opposition to the return spring 33.

In the center of the circuit board 35 there is provided a bulb hole 37 in which a light bulb 38 is inserted upward and fitted. The circuit board 35 is placed on the lower case 40. A plurality of terminals 41 are integrally provided in the lower case 40 in such a manner that one end is connected to the circuit board 35 and the other end projects into the coupler 19 which is formed integral with the lower case 40.

In a portion of the lower case 40 there is provided a recessed portion 42 in which a slider 43 is able to slide. The slider 43 is integrally provided with an upward open holder portion 44 of a hollow pillar shape. When the lower case 40 and the upper case 13 are assembled into a unit, the holder portion 44 is installed in the step section 18, and a leg portion 11*b* provided in the slide knob 11*a* is inserted through a slot 29 formed in the upper wall of the step section 18 into the holder portion 44 whereby the slider 43 is arranged to move together with the slide knob 11*a*. Not shown in the drawing but, the movable contact 34 is provided on the slider 43 while the fixed contact is provided on the back wall of the circuit board 35, so that the connection of the contacts is switched by the movement of the slider 43.

The reference character 45 denotes a click pin and the reference character 46 denotes a click spring. The click pin 45 and the click spring 46 constitute a click mechanism which gives the click feeling to the movement of the slider 43. The reference character 47 denotes a photo conductive member which conducts the light of the bulb 38 to the inside of the step section 18. The reference character 48 denotes an engaging bore formed in the lateral wall of the upper case 13. When the lower case 40 is fitted upward into the inside of the downward open upper case 13, a claw 49 formed on the lateral wall of the lower case 40 is engaged with the engaging bore 48 thereby allowing the upper and lower cases to be combined together.

When assembling this mirror switch 10, firstly the slider 43 is fitted into the concave portion 42 of the lower case 40. Then, the circuit board 35 in the bulb hole 37 of which the bulb 38 is previously fitted is placed on the lower case 40 so as to be combined into a lower case sub-assembly.

Next, the switch element and the photo conductive member 47 are installed in the upper case 13 and housed in the predetermined locations on the back side of the concave portion 14. The lower case sub-assembly is fitted in the upper case 13 from the lower side, and the claws 49 are engaged with the engaging bores 48, whereby the upper case 13 and the lower case 40 are combined into an upper and lower case sub-assembly.

In the upper and lower case sub-assembly, since the upper portions of the actuator rods 28 project upward from the through holes 27, the seal plate 22 is placed on the seat portion 14*a* of the concave portion 14 in such a manner that the lift springs 17 are put on these actuator rods 28. Then, since the knob mounting section 20 projects upward from the central opening 26 of the seal plate 22, a sub-assembly that the joint member 21 is integrally engaged through the engaging projections 23 with the inside of the operation knob 15 in advance, is put on the knob mounting section 20, and the engaging projections 25 of the knob mounting section 20 are engaged with the engaging holes 24 of the joint member 21, whereby the operation knob 15 and the joint member 21 are combined together. After that, the leg portion 11*b* is inserted through the slot 29 into the holder portion 44 located inside of the step section 18, so that the mirror switch 10 is assembled.

Figure 5:
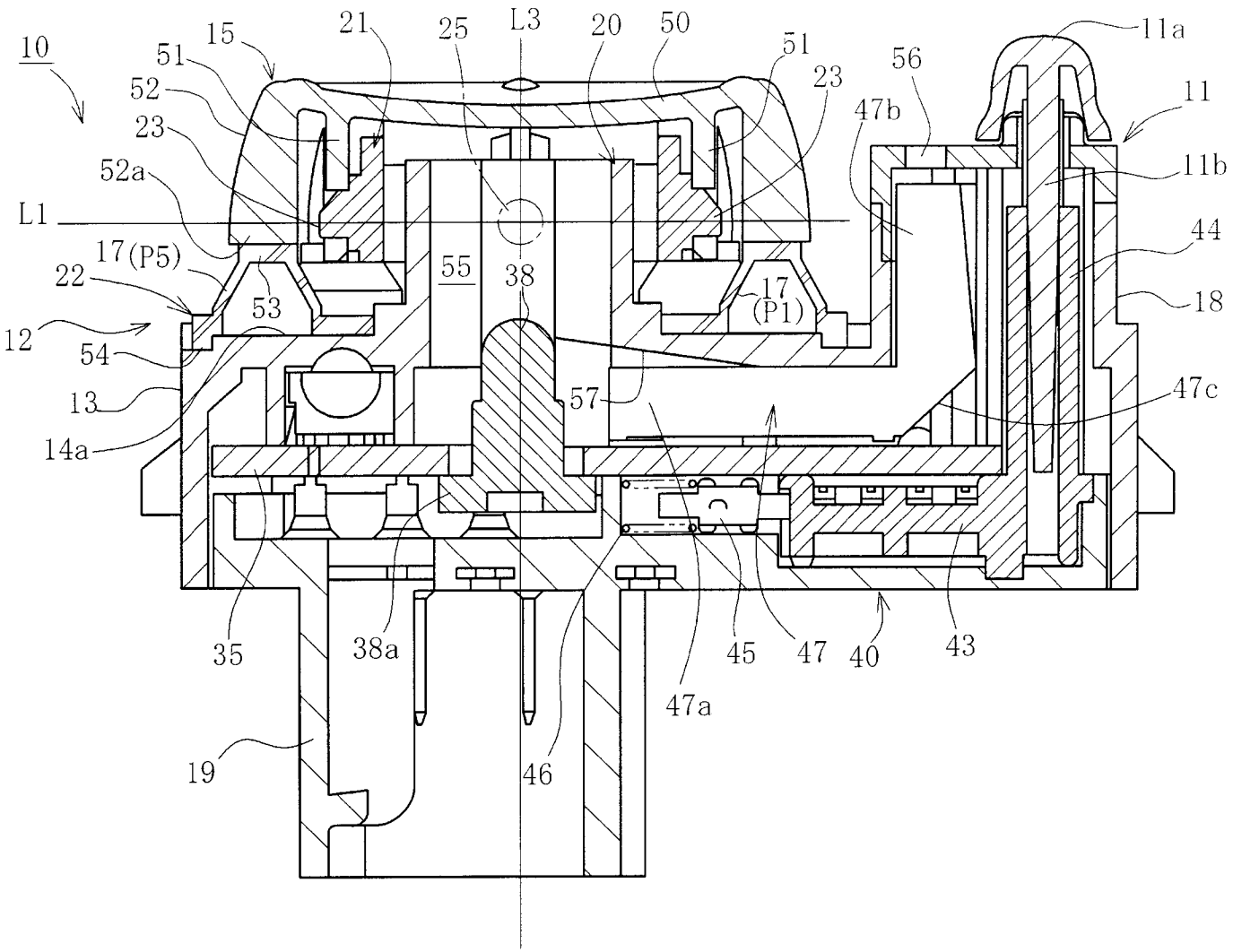
FIG. 5 is a cross sectional view taken along line 5-5 in FIG. 2.

FIG. 5 is a cross sectional view taken on line 5-5 of FIG. 2. The cross section is taken along the first central axis L1 of rocking movement (FIG. 1) passing the pair of engaging projections 23 across the center axis L3 of the knob mounting section 20. A top wall 50 of the operation knob 15 is formed in the concave shape that the center is depressed downward. A pair of downward extending right and left mounting legs 51 is formed integrally on the back side of the top wall 50. The pair of engaging projections 23 extending from the joint member 21 is engaged with the mounting leg 51 thereby allowing the operation knob 15 and the joint member 21 to be combined together.

Since the right and left engaging projections 23 are located on the first central axis L1 of rocking movement, the operation knob 15 is able to be rocked around the first axis of rocking movement. At this time, since the joint member 21 is integrally engaged through the engaging projections 25 with the operation knob 15, it is not rocked together with the operation knob 15. However, when the operation knob 15 is rocked around the engaging projections 25, the joint member 21 is rocked together.

A lower end wall 52*a* of a peripheral wall portion 52 of the operation knob 15 abuts on flat upper end walls 53 of the lift springs 17. The upper end walls 53 are adapted to support the lower end wall 52*a* of the peripheral wall portion 52 of the operation knob 15 and to level the lower end wall 52*a* of the peripheral wall portion 52 in the case where the lift springs 17 are not elastically deformed. When the lift springs 17 are compressed and elastically deformed, the upper end walls 53 spring-bias the lower end walls 52*a* of the peripheral wall 52 so as to push the same upward up to the horizontal level. The lift spring 17 is formed in a hollow substantially frustoconical shape (hereinafter, referred to as dome shape). Two lift springs 17 as shown in FIG. 5 are located each in positions corresponding to the press points P1 and P5 and have empty insides without accommodation of the actuator rod. The one with such empty inside will be referred to as dummy.

The seal plate 22 is formed on the periphery thereof with a one-step lower step portion 54 which is fitted on the periphery of the seat portion 14*a* and adheres close to the concave portion 14 located on the periphery of the seat portion 14*a*. In this way, the fitting region between the periphery of the seal plate 22 and the periphery of the seat portion 14*a* of the concave portion 14 is fluid lightly sealed and waterproofed so as not to allow the water to enter the inside of the switch case from the through holes 27 of the seat portion 14*a* (see FIG. 4 and FIG. 16). The bulb 38 is fitted in the lower portion of an axial hole 55 formed in the center of the knob mounting section 20.

The photo conductive member 47 is formed in the substantially L-shaped cross section, and has a horizontal portion 47*a*, a vertical portion 47*b* and a reflection wall 47*c* formed by an inclined wall of 45 degrees at the bent corner between the horizontal portion and the vertical portion. One end of the horizontal portion 47*a* is located in the vicinity of the bulb 38. A portion of the reflection wall 47*c* on the side of the other end of the horizontal portion is arranged in the vicinity of the holder portion 44. The vertical portion 47*b* is arranged in the step section 18 in the upward and downward direction to extend substantially parallel to the holder portion 44.

With this construction, the light of the bulb 38 is conducted from the horizontal portion 47*a* to the peripheral portion on the side of the holder portion 44 and bent at substantially at right angles by the reflection wall 47*c*. Then, the light is conducted upward in the vertical portion 47*b*, whereby the position of the slide switch 11 is displayed by the transmitted light through a lens 56 provided in the top wall of the step section 18. An inclined wall 57 being cut obliquely downward in the direction of the reflection wall 47*c* is formed on the lower end of the knob mounting section 20 and on the bottom wall of the concave portion 14 located above the one end of the horizontal portion 47*a* in the vicinity of the bulb 38, thereby making it easier to conduct the light of the bulb 38 to the photo conductive member 47.

Figure 6B:
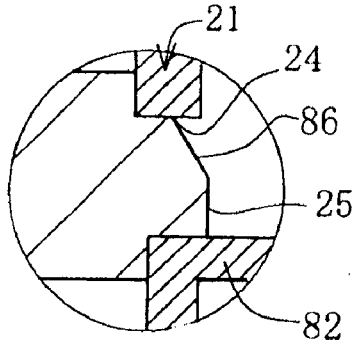
FIG. 6B is a close-up view of an engaging portion of the mirror switch.
Figure 6A:
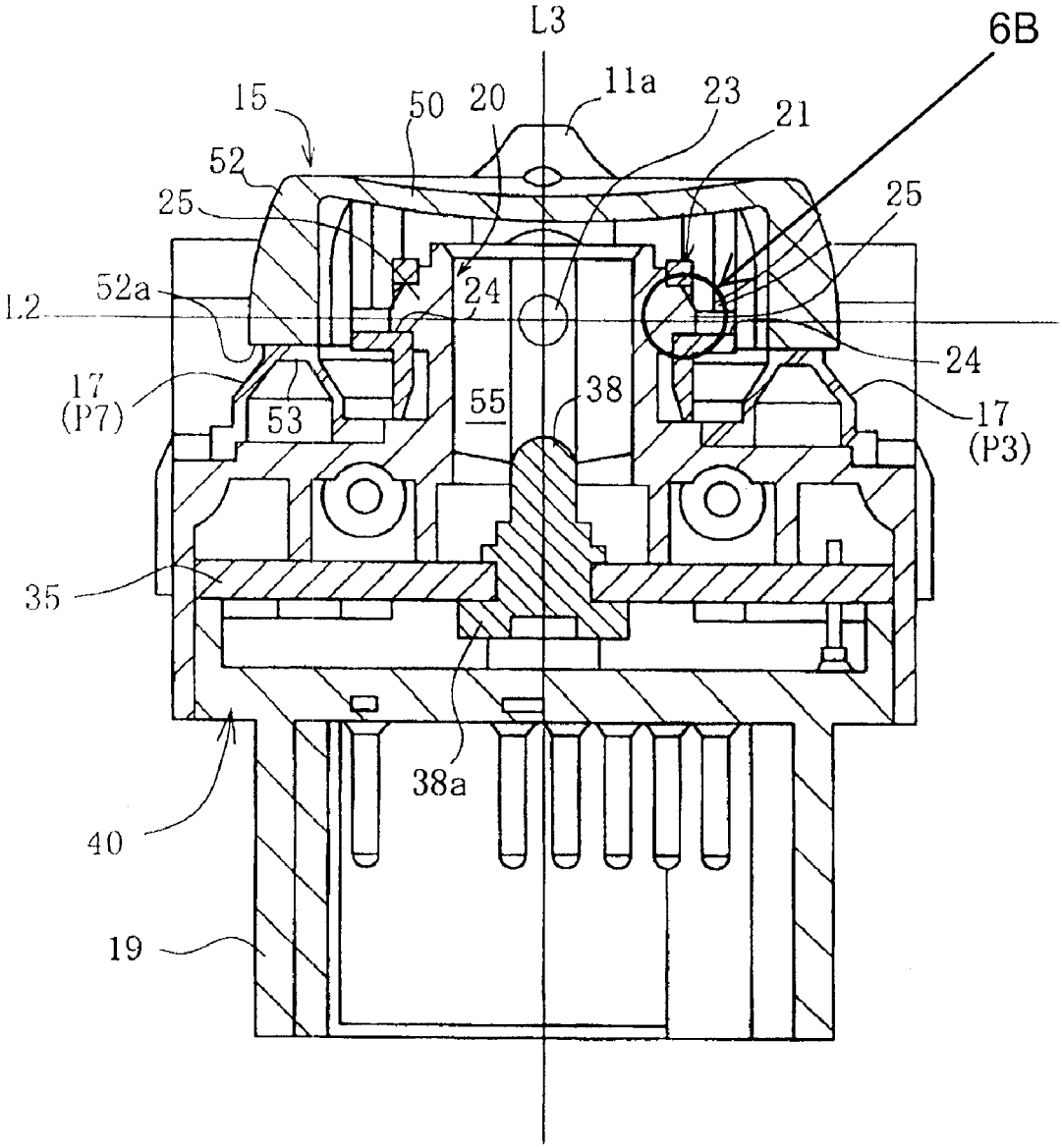
FIG. 6A is a cross sectional view taken along line 6-6 in FIG. 1.

FIG. 6A is a cross section taken on line 6-6 in FIG. 1 and also the cross section taken along the second central axis L2 of rocking movement. The pair of engaging projections 25 extending outwardly on the right and left sides of the upper portion of the knob mounting section 20 is engaged with each of the engaging holes 24 provided in the joint member 21. According to this construction, the joint member 21 is able to move around the engaging projections 25, i.e. around the second central axis L2 of rocking movement together with the operation knob 15.

At this time, only the operation knob 15 is able to be rocked in the right and left direction of the drawing around the engaging projections 23 as a pivot in relation to the joint member 21. Then, the joint member 21 is combined through the engaging projections 25 with the knob mounting section 20, so that it is not able to be rocked. However, when the operation knob 15 is rocked around the second axis of rocking movement, the joint member 21 is rocked around the engaging projections 25 in relation to the knob mounting section 20 together with the operation knob 15. Like this, the operation knob 15 is universally jointed through the joint member 21 with the knob mounting section 20 by the engaging projections 23 and 25 constituting the first and second rocking pivots along the first and second central axes L1 and L2 of rocking movement. The operation knob 15 is able to be rocked in an optional direction relative to the knob mounting section 20 by being pressed down an optional location thereof around the center line L3 (FIG. 2).

Figure 7:
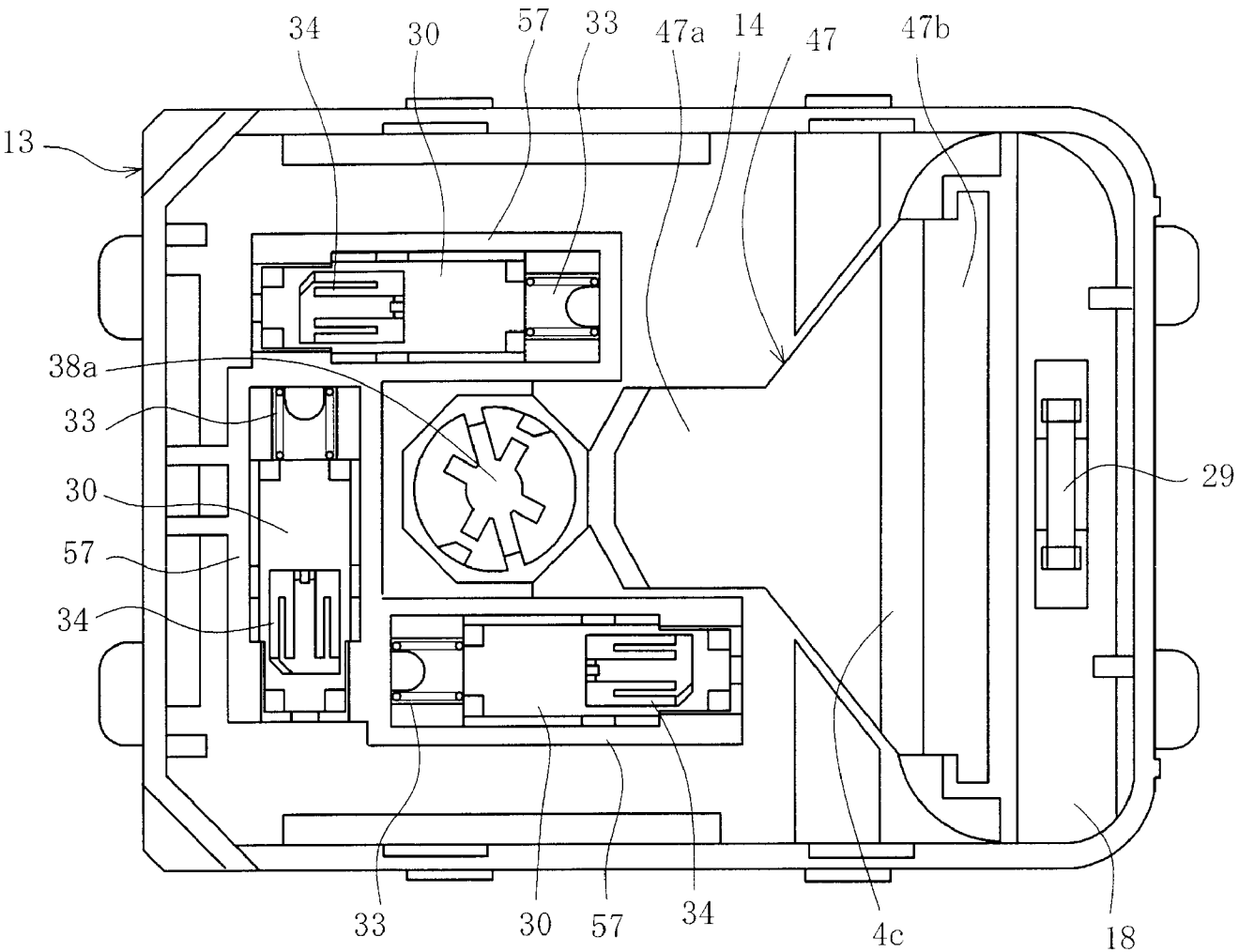
FIG. 7 is a bottom view of an upper case.

FIG. 7 is a bottom view of the upper case 13 in which the switch elements and the photo conductive member 47 are installed. In the upper case 13, there are provided three substantially rectangular slide frames 57 in such a manner as to surround the axial hole 55 in the center. Within each of slide frames, the slider 30 is slidably accommodated. An end of each return spring 33 abuts and is fixed on a wall on one of short sides of the slide frame 57.

The one end of the horizontal portion 47*a* of the photo conductive member 47 is arranged in the vicinity of the socket portion 38*a* of the bulb 38 and in the location where the slide frame 57 is not provided. The vertical portion 47*b* is positioned within the step section 18. Namely, the photo conductive member 47 is formed in a substantially triangular shape which is widened toward the step section 18 located on the peripheral side, whereby the wide portion extends within the step section 18.

Figure 8:
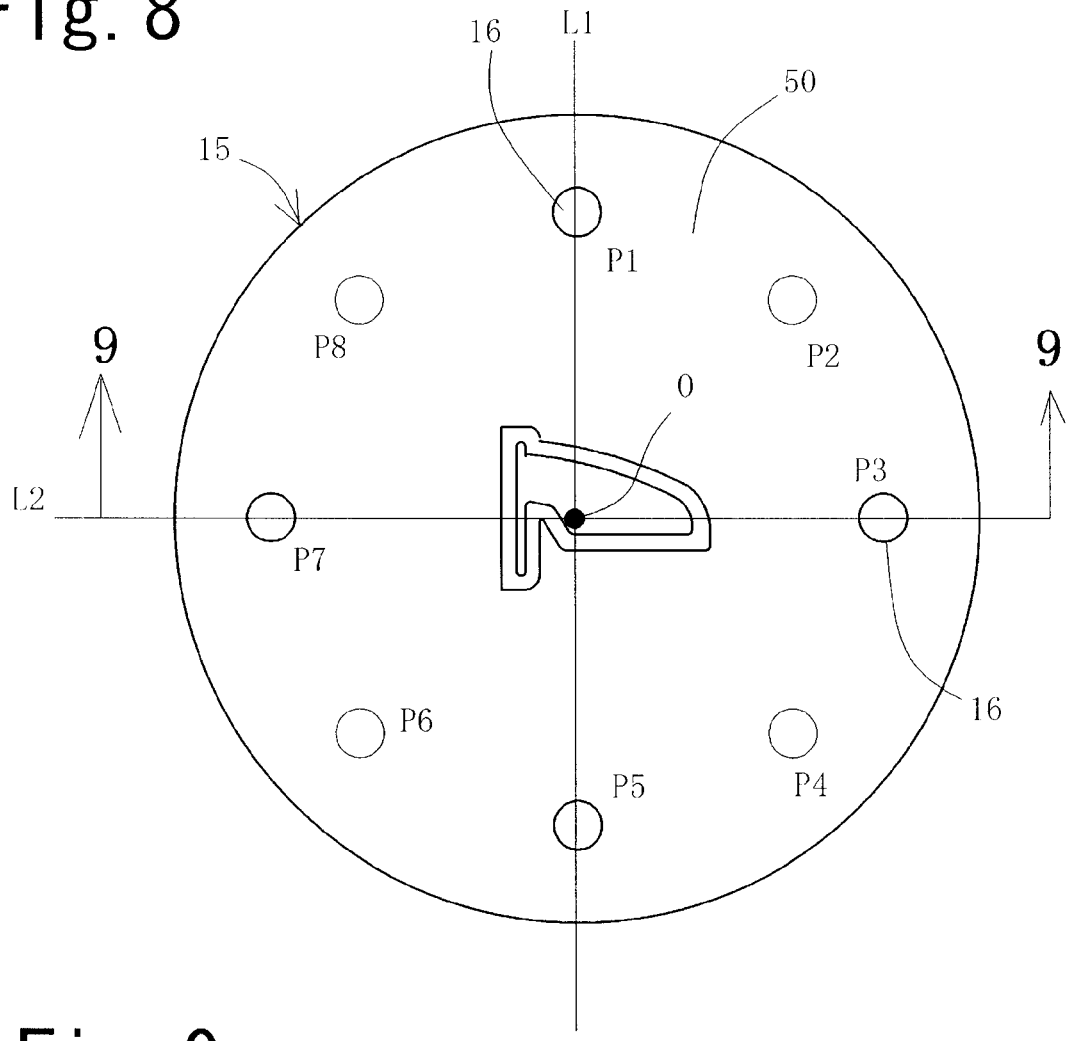
FIG. 8 is a plan view of an operation knob.
Figure 9:
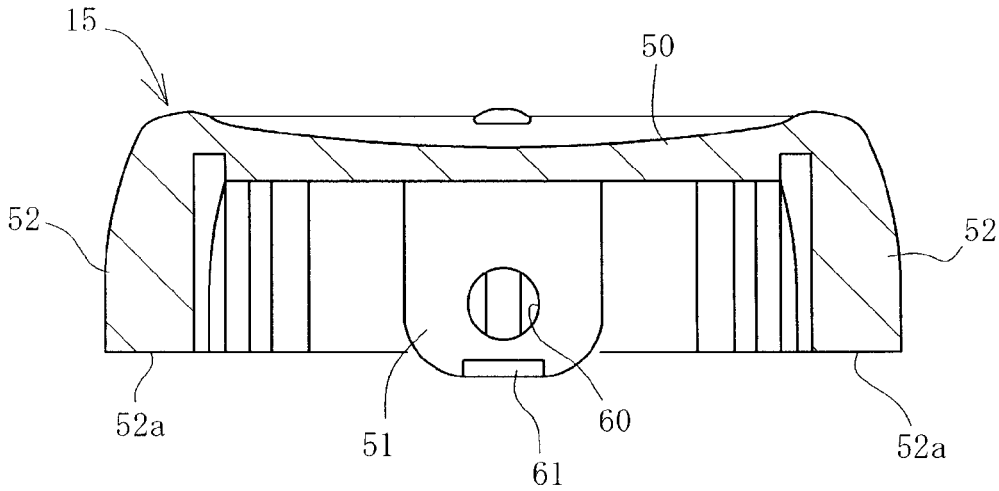
FIG. 9 is a cross sectional view taken along line 9-9 in FIG. 8.
Figure 10:
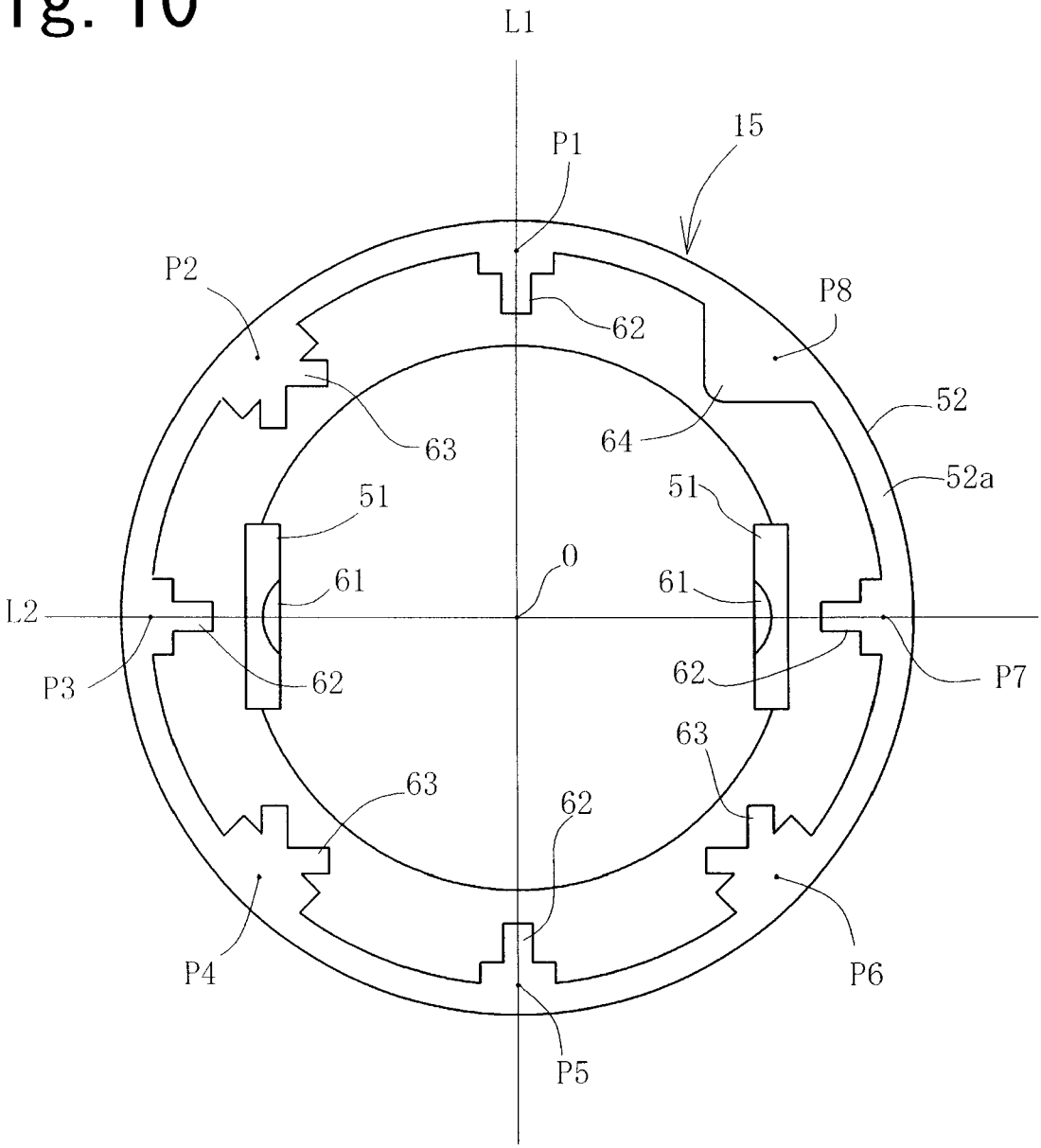
FIG. 10 is a bottom view of the operation knob.

FIG. 8 through FIG. 10 show the operation knob 15, wherein FIG. 8 is a plan view, FIG. 10 is a bottom view and FIG. 9 is a cross sectional view taken on line 9-9 in FIG. 8. As shown in these drawings, the operation knob 15 is in the shape of a downward open vessel which has the top wall 50 and an annular peripheral wall 52 formed around the top wall. From the back side of the operation knob 15, there integrally projects the pair of mounting legs 51 in each distal end of which an engaging bore 60 is provided. On a tip side from the engaging bore 60 there is provided a guide slope 61 which gradually decreases the thickness toward the tip end. When the joint member 21 is pressed into between the pair of peripheral wall 52, each of the engaging projections 23 is guided by the guide slope 61 so as to be easily engaged with the engaging bore 60.

Further, as shown in FIG. 10, a lower end 52*a* of the peripheral wall 52 is provided with a total of eight press ribs 62, 63, 64 integrally formed at intervals of about 45 degrees in the circumferential direction. Among these ribs, the ribs 62 formed in the locations corresponding to the press points P1, P3, P5 and P7 have a single radial projection and reflect the movement along any one of the first central axis L1 of rocking movement and the second central axis L2 of rocking movement.

The ribs 63 formed in the locations corresponding to the press points P2, P4 and P6 have a substantially V-shape in the bottom view and are located about 45 degrees off the first central axis L1 of rocking movement or the second central axis L2 of rocking movement. When the operation rib 15 is rocked in either direction around a straight line which is about 45 degrees off the first central axis L1 of rocking movement and the second central axis L2 of rocking movement, the rib 63 is able to press the lift spring. The rib 64 corresponding to the press point P8 has a substantially triangular shape and functions as a press portion.

Figure 11:
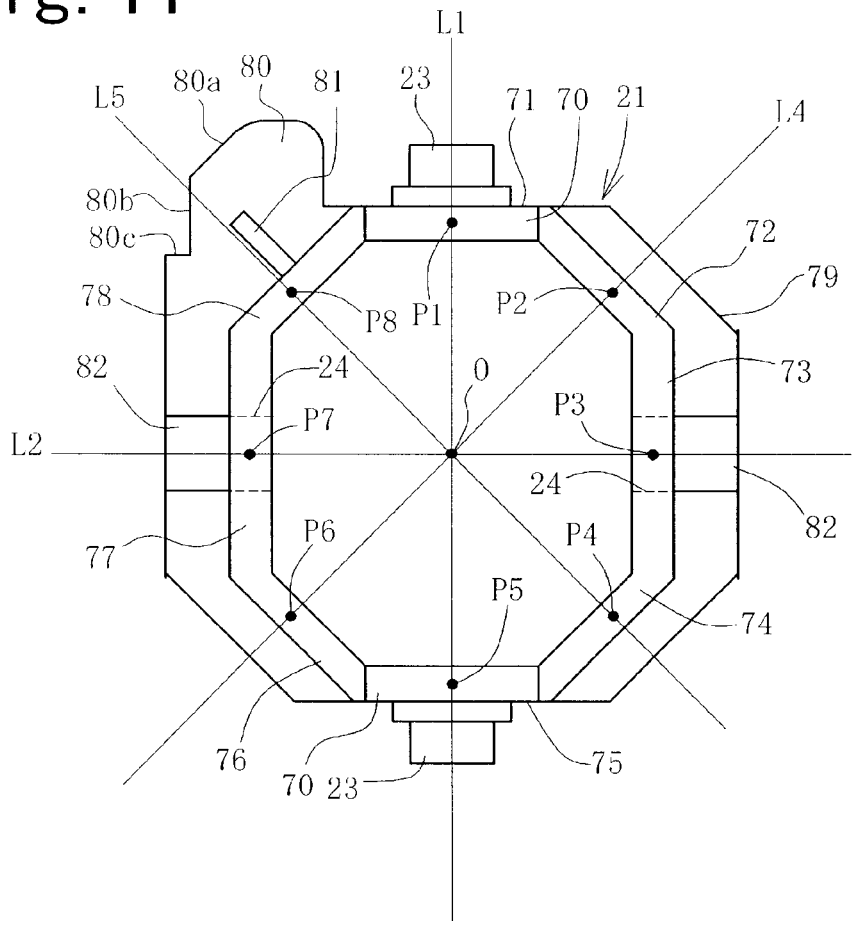
FIG. 11 is a plan view of a joint member.
Figure 12:
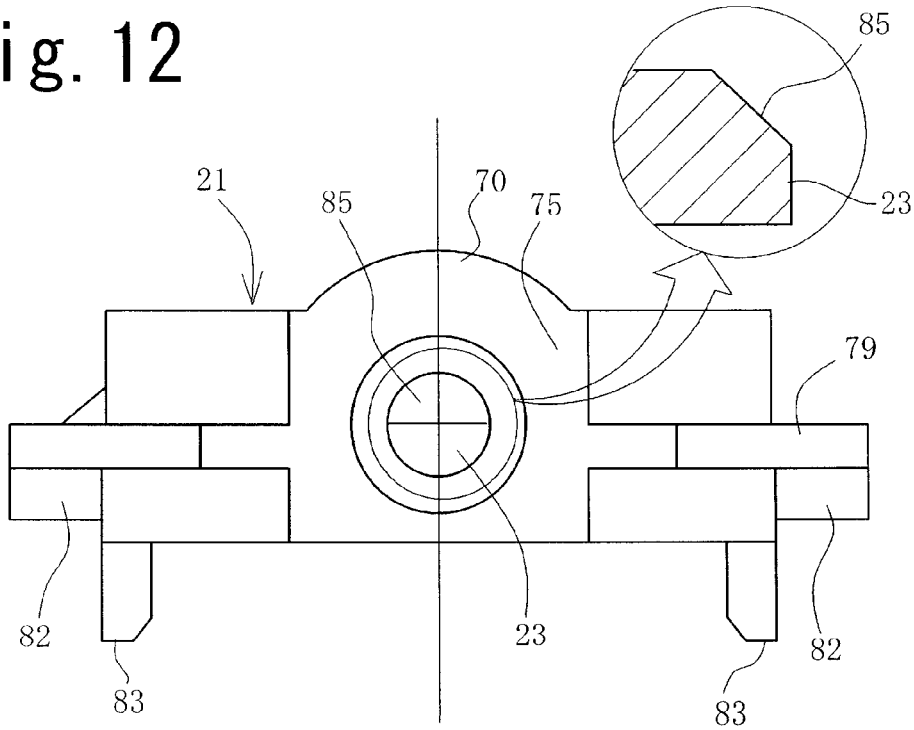
FIG. 12 is a front view of the joint member.
Figure 13:
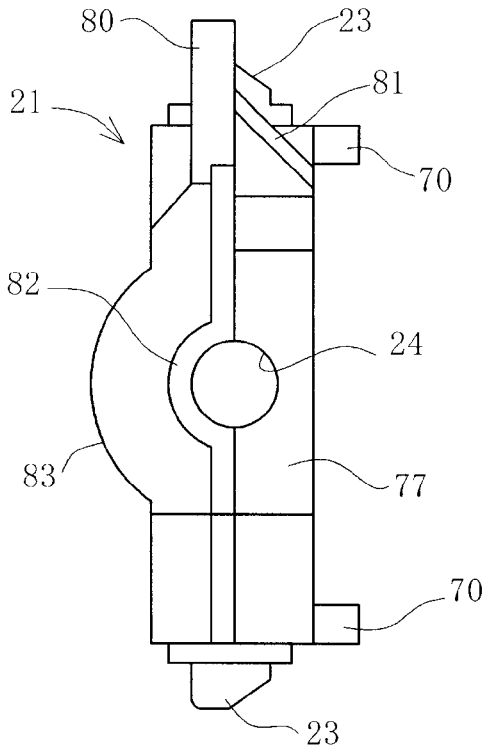
FIG. 13 is a side view of the joint member.
Figure 14:
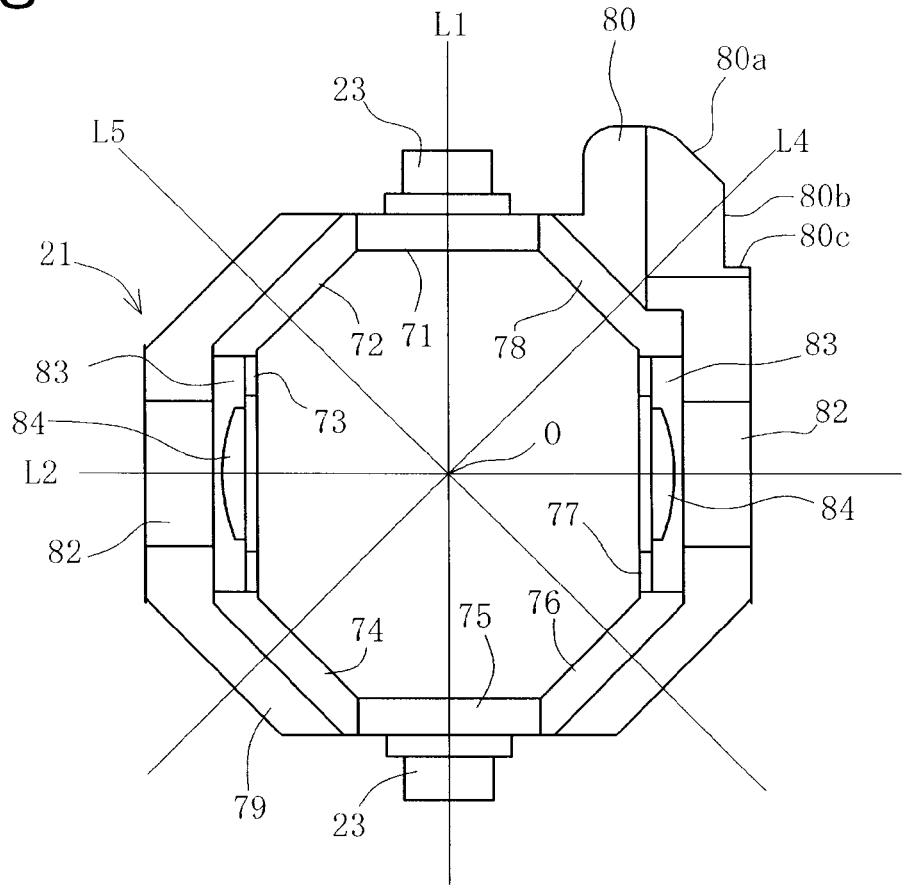
FIG. 14 is a bottom view of the joint member.

FIG. 11 through FIG. 14 show the joint member 21, wherein FIG. 11 is a plan view of the joint member 21, FIG. 12 is a front view thereof, FIG. 13 is a left side view thereof, and FIG. 14 is a bottom view thereof. The wall formed with the engaging projection 23 is provided with an upward raised circular arc-shaped upper portion 70 and is formed thin so as to be easily elastically deformed. An upper half of the tip of the engaging projection 23 has a slope 85 for facilitating the engagement with the guide slope 61 for the engaging bore 60.

The substantially octagonal peripheral wall of the joint member 21 is partitioned into a first wall 71 through an eighth wall 78. The first wall 71 through the eighth wall 78 are located in positions corresponding to the press point P1 through the press point P8. Laterally substantially horizontally projecting ribs 79 are integrally formed on the peripheral wall other than the first wall 71 and the fifth wall 75. The rib 79 of the eighth wall 78 extends further upward in the drawing to form an interlocking press section 80. The interlocking press section 80 protrudes up to the position overlapping with the lift spring 17 corresponding to the press point P8 (see FIG. 15). As shown in FIG. 13, the interlocking press section 80 is reinforced by a slant rib 81.

In the ribs 79 provided on the outward side of the third wall 73 and the seventh wall 77 there are formed downward curved concaves 82 each of which constitutes an escape portion for allowing the engaging projection 25 to be engaged with the engaging hole 24. The third wall 73 and the seventh wall 77 are formed each with a downward projecting arc-shaped lower portion 83 an inner wall of which has a tapered wall 84 being formed thinner in the downward direction to make the engagement of the engaging projection 25 easy when the joint portion 21 is fitted on the knob mounting section 20.

Incidentally, as shown in FIG. 6B, the tip of the engaging projection 25 has an upper half formed with a tapered wall 86 for facilitating the engagement with the engaging hole 24.

Further, the lower end of the arc-shaped lower portion 83 comes into contact with a step portion formed in the lower portion of the lateral wall of the knob mounting section 20 and functions as a fulcrum when the joint member 21 is rocked around the engaging projections 25.

Figure 15:
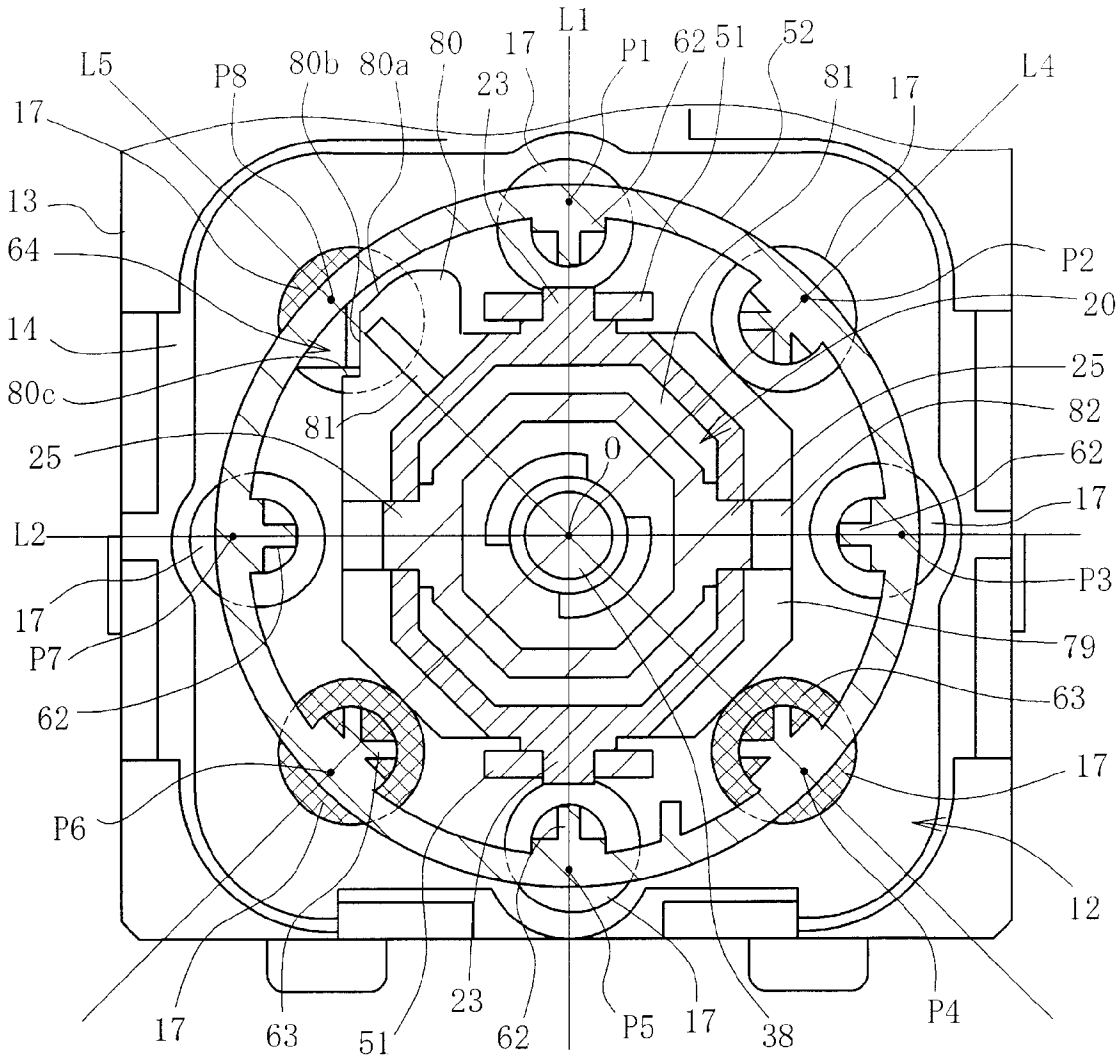
FIG. 15 is a cross sectional view taken along line-15-15 in FIG. 2.

FIG. 15 is a cross sectional view taken on line 15-15 in FIG. 2. In the press points P1 through P7 of the peripheral wall portion 52, the press ribs 62 and the press ribs 63 are located on the lift springs 17. Moreover, in the press point P8, the interlocking press section 80 and the press rib 64 are located on the lift spring 17. By the way, an inclined portion 80*a* formed on the lateral side of the interlocking press section 80 is so formed as to avoid interference with the inner peripheral wall of the peripheral wall portion 52. Also, cutout portions 80*b* and 80*c* are so formed as to avoid interference with the press rib 64.

The operation knob 15 is universally rocked around the first central axis L1 of rocking movement passing each center of the upper and lower engaging projections 23 or the second central axis L2 of rocking movement passing each center of the right and left engaging projections 25. In response to such rocking movement, any of the lift springs 17 can be selectively pressed down.

Among the lift springs 17, the ones that the switch element is provided are each of the lift springs corresponding to the press points P4, P6 and P8 (shown by hatching, for convenience) and are located on straight lines L4 and L5 which are about 45 degrees off the first central axis L1 of rocking movement and the second central axis L2 of rocking movement wherein on the straight line L4, only the lift spring 17 corresponding to the press point P6 is located. The lift spring 17 corresponding to the press point P1 located on a diagonal line has no switch element and is the dummy having an empty inside. The lift springs 17 which have the switch element arranged correspondingly to the press points P4 and P8 are located diagonally opposite to each other on the straight line L5.

When the operation knob 15 is rocked around the first central axis of rocking movement, it is rocked solely around the engaging projections 23. Accordingly, when the press point P3 is pressed on the right side of the drawing relative to the first central axis L1 of rocking movement, the right side of the operation knob 15 is rocked in such a manner as to be pressed downward, so that the lift spring 17 corresponding to the press point P3 and the neighboring two lift springs 17 corresponding to the neighboring upper and lower press points P2 and P4, i.e. a total of three lift springs are simultaneously compressed and elastically deformed. At this time, one switch element arranged correspondingly to the press point P4 is switched. On the other hand, when the press point P7 located on the left side of the first central axis L1 of rocking movement, the left side of the operation knob 15 is pressed downward, so that a total of three lift springs 17 corresponding to the press point P7 and the neighboring upper and lower press points P8 and P6 are simultaneously compressed and elastically deformed. Then, two switch elements arranged correspondingly to the press points P6 and P8 are simultaneously switched.

When being rocked around the second central axis L2 of rocking movement, the operation knob 15 comes into engagement through the engaging projection 23 with the joint member 21. Then, as the joint member 21 is rockable around the engaging projections 25, the operation knob 15 is rocked together with the joint member 21. When the press point P1 located on the upper side in the drawing of the second central axis L2 of rocking movement is pressed, the upper side of the operation knob 15 is rocked in such a manner as to be pressed downward, so that a total of three lift springs 17 corresponding to the press point P1 and the neighboring right and left press points P8 and P2 are simultaneously compressed and elastically deformed. At this time, one switch element arranged correspondingly to the press point P8 is switched.

On the contrary, when the press point P5 located on the lower side of the second central axis L2 of rocking movement is pressed, the lower side of the operation knob 15 is pressed downward, so that a total three lift springs 17 corresponding to the press point P5 and the neighboring right and left press points P4 and P6 are simultaneously compressed and elastically deformed. Then, two switch elements arranged correspondingly to the press points P4 and P6 are switched.

In the case of being rocked around the diagonal straight line L4, when the right lower press point P4 is pressed, the right lower side of the operation knob 15 is rocked in such a manner as to be pressed downward, so that a total three lift springs 17 corresponding to the press point P4 and the neighboring press points P3 and P5 are simultaneously compressed and elastically deformed. At this time, one switch element arranged correspondingly to the press point P4 is switched.

On the other hand, when the press point P8 located on the left upper side relative to the straight line L4 is pressed, the left upper side of the operation knob 15 is pressed downward, so that a total of three lift springs 17 corresponding to the press point P8 and the neighboring press points P1 and P7 are simultaneously compressed and elastically deformed. At this time, one switch element arranged correspondingly to the press point P8 is switched.

In the case of being rocked around the diagonal straight line L5, when the right upper press point P2 is pressed, the right upper side of the operation knob 15 is rocked in such a manner as to be pressed downward, so that a total three lift springs 17 corresponding to the press point P2 and the neighboring press points P1 and P3 are simultaneously compressed and elastically deformed. At this time, since there is no switch element arranged correspondingly to the press points P1, P2 and P3, the switching is not directly carried out.

However, since the right upper side is pressed downward, the upper side of the joint member 21 is rocked around the second central axis L2 of rocking movement in such a manner as to be pressed downward. At the same time, the tip end side of the interlocking press member 80 is pressed downward, and the press point P8 also allows the corresponding lift spring 17 to be compressed and elastically deformed. At this time, one switch element arranged correspondingly to the press point P8 is switched. Therefore, even if all the three lift springs 17 to be elastically deformed are dummy, the switch element located in the position that it is not directly pressed by the operation knob 15 is switched through the interlocking press member 80, whereby the operation of the motor in response to the operation of the operation knob 15 is able to be obtained.

On the other hand, when the press point P6 located on the left lower side relative to the straight line L5, the left lower side of the operation knob 15 is pressed downward, so that a total of three lift springs 17 corresponding to the press point P6 and the neighboring press points P5 and P7 are simultaneously compressed and elastically deformed. At this time, one switch element arranged correspondingly to the press point P6 is switched.

Figure 16:
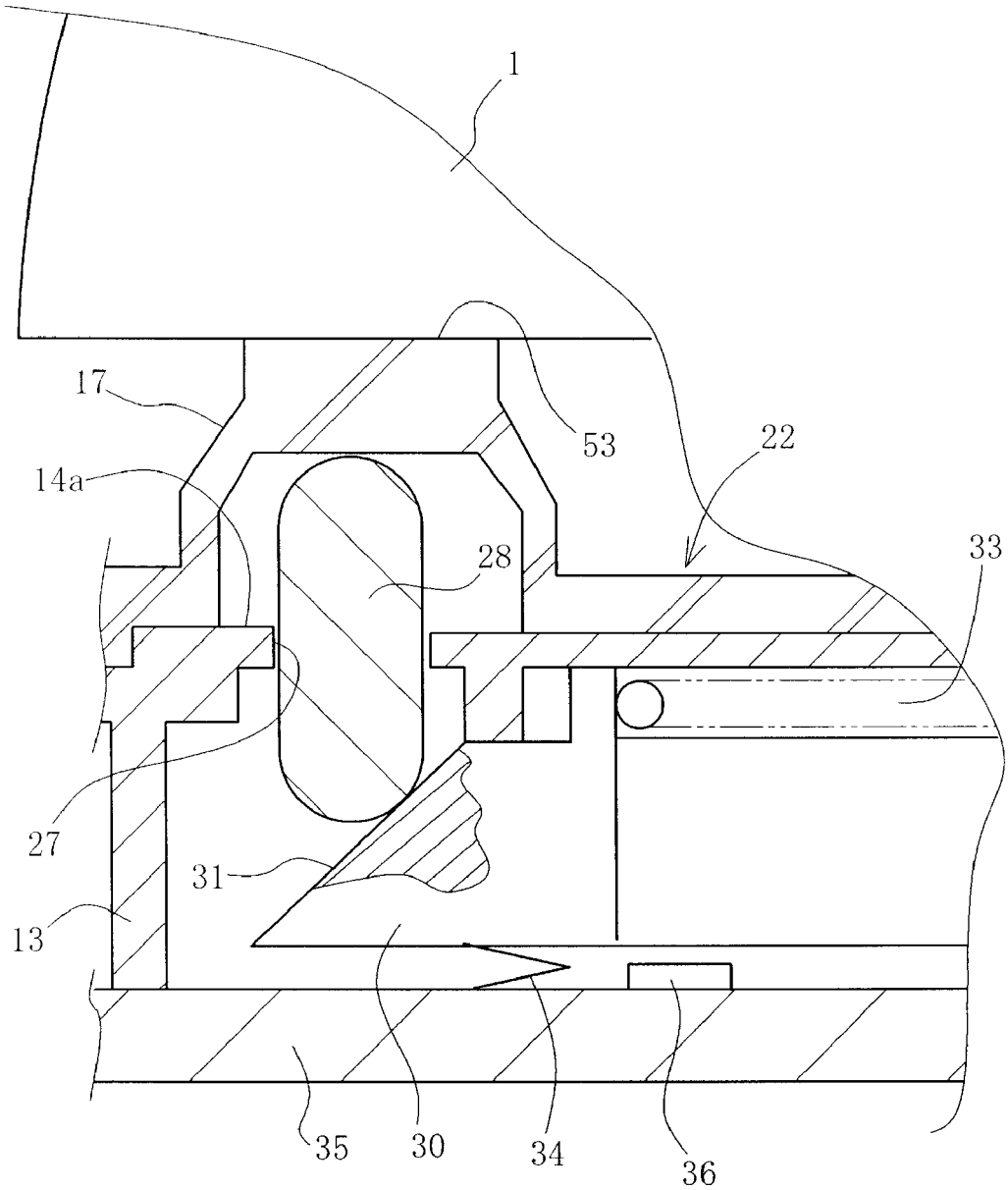
FIG. 16 is a view showing the construction of a switch element.

FIG. 16 shows the construction of the switch element. When explaining an example of the switch element arranged correspondingly to the press point P4, an upper part of the actuator rod 28 is fitted into the inside of the lift spring 17 and arranged in the vertical direction. When the lift spring 17 is pressed downward, the actuator rod 28 is pressed downward to push the slant wall 31 of the slider 30 on which the lower end portion of the actuator rod 28 abuts, whereby the slider 30 is moved in opposition to the return spring 33 in such a manner that the movable contact 34 is contacted with and separated from the fixed contact 36 on the circuit board 35. Other switch elements are similarly constructed.

FIG. 17 is a table of the switching of each switch element corresponding to each of the press points of the operation knob 15. The switch elements are shown in a horizontal row, and each of the switch elements is designated by "a", "b" and "c" according to the corresponding press points P4, P6 and P8. The press points are shown in a vertical column. In the case where there is the switch element to be switched by pressing the press point, the column of the switch element to be switched is marked with a circle.

For example, when the press point P1 is pressed, the switch element which is arranged correspondingly to the press point 8 is switched. Therefore, the corresponding column "c" is marked with a circle. The column of a motor operating direction designates a mirror tilt direction by controlling the motor through the switching of one or more switching elements. In the above example, the mirror is tilted upward by operating the upward and downward adjustment motor. Therefore, "upward" is entered in the column. The rest is similar to this example, and the switching of the switch elements when each of the press points is pressed is designated in the same way as the above described. Incidentally, "right" and "left" are explained here for example about the mirror provided on the right side of the vehicle body. In the present case, "right" means that the mirror tilts in the right direction (outward) which is the direction departed from the vehicle body and "left" means that the mirror tilts in the left direction (inward) which is the direction approached to the vehicle body. Naturally, the movement is reversed for the mirror provided on the left side of the vehicle body, namely, "right" means that the mirror tilts in the right direction (inward) which is the direction approached to the vehicle body and "left" means that the mirror tilts in the left direction (outward) which is the direction departed from the vehicle body. Following explanation is done for the mirror provided on the right side of the vehicle body.

Like this, even if any of the eight press points arranged at intervals of about 45 degrees is pressed selectively, the motor is actually moved in any of the upward, downward, right and left directions in the same way as any of the basic four press points P1, P3, P5 and P7 located in the upward, downward, right and left directions is pressed except where the press point P6 is pressed as described later. To put it concretely, when the press points P2 and P8 are pressed, the upward and downward adjustment motor is operated to tilt the mirror upward in the same way as the press point P1 is pressed (this direction of operation corresponds to the normal rotation direction of the upward and downward adjustment motor).

Incidentally, when the press point P3 is pressed, the right and left adjustment motor is operated to tilt the right side of the mirror in the outward open direction (this direction of operation corresponds to the normal rotation direction of the right and left adjustment motor). Also, when the press point P4 is pressed, the right and left adjustment motor is operated to tilt the right side of the mirror in the same way as the press point P3 is pressed. However, only when the press point P6 is pressed, the mirror is tilted not only downward but also leftward by means of the circuit setting.

When the press point P7 is pressed, the motor is operated to tilt the right side of the mirror in the inward direction (this direction of operation corresponds to the reverse rotation direction of the right and left adjustment motor). When any of the press points other than P3, P7 and P4 is pressed, the right and left adjustment is not carried out.

As described above, the joint member 21 is linked with the operation knob 15, and, even when the press point 2 which never directly presses the switch element is pressed, the interlocking press section 80 presses, through the interlocking movement of the joint member 21, the switch element corresponding to the press point P8 different from the press point P2. Therefore, even if any press point is pressed, there is the responsive movement of the motor without exception and there is no possibility of being recognized as a malfunction.

On the contrary, in the case where the operation knob 15 is merely universally jointed with the knob mounting section 20 without the joint member 21, since the switch element is small in number than the press point, there is such a press point (corresponding to the press point P2 in this embodiment) that only the dummy is pressed without pressing the switch element. Consequently, when the press point is pressed, there is a possibility of being recognized as a malfunction without responsive movement of the motor. In this embodiment, such problem can be solved.

Next, the operation of this embodiment will be explained. As shown in FIG. 15 and others, the operation knob 15 is so mounted on the joint member 21 through the engaging projections 23 constituting the first rocking pivot as to be rockable around the first central axis L1 of rocking movement, and the joint member 21 is so mounted on the knob mounting section 20 of the upper case 13 through the engaging projections 25 constituting the second rocking pivot as to be rockable around the second central axis L2 of rocking movement meeting at right angles with the first central axis L1 of rocking movement, in such a manner that the operation knob 15 is universally jointed through the joint member 21 with the upper case 13. Therefore, the operation knob 15 is able to be rocked in all the directions. Also, since the rocking movement is done around the engaging projections 23 and 25 as the first and second rocking pivots, the properly controlled steady operation feeling can be obtained by removing the fluffy unsteady feeling, whereby the reliability of operation can be improved.

Further, even if the full dummy press point P2, that the lift spring 17 having no corresponding switch element is elastically deformed by the operation knob 15, is formed because the number of the switch elements is smaller than the number of the lift springs 17, the joint member 21 is rocked in connection with the pressing of the full dummy press point P2 when the dummy press point P2 is pressed. At the same time, the interlocking press section 80 of the joint member 21 presses the press point P8 having the corresponding switch element, so that the switch element corresponding to the press point P8 is switched, thereby allowing the upward and downward adjustment motor to be operated in the normal direction of rotation. Therefore, no responsive operation such as no operation of the motor at the time of operating the full dummy press point P2 is avoided and the responsive operation can be surely carried out, whereby a misunderstanding of a malfunction or the like is not caused, so as to improve the reliability of operation.

As shown in FIG. 5 and FIG. 8 through FIG. 14, since the engaging projection 23 constituting the first rocking pivot is provided on the joint member 21, the joint member 21 can be easily engaged integrally with the operation knob 15. In addition, since the distal end of the engaging projection 23 is formed with the tapered wall 61, the engagement can be further facilitated. Moreover, since the tip portion of the mounting leg 51 with which the engaging projection 23 is engaged is formed as the guide slope 61, the engagement can be furthermore facilitated.

Further, since the engaging projection 25 constituting the second rocking pivot is provided on the knob mounting section 20, the knob mounting section 20 can be easily engaged integrally with the joint member 21. In addition, since the distal end of the engaging projection 25 is formed with the tapered wall 86, the engagement can be further facilitated. Moreover, since the tapered wall 84 is provided on the arc-shaped portion 83 of the joint member 21 with which the engaging projection 25 is engaged, the engagement of the engaging projection 25 at the time of being fitted on the knob mounting section 20 can be further facilitated.

As shown in FIG. 4, FIG. 5 and FIG. 7, since the light bulb 38 is housed in the hollow space of the knob mounting section 20, the transmitted light display on the operation knob 15 is easily done. Moreover, since the bulb 38 is located in the center position of the concave portion 14 and a small number (three in the embodiment) of the switch elements are arranged around the bulb, the photo conductive member 47 for conducting the light of the bulb from the center of the switch case to the peripheral area thereof can be efficiently arranged by using the space in which the switch element is not arranged.

Figure 18:
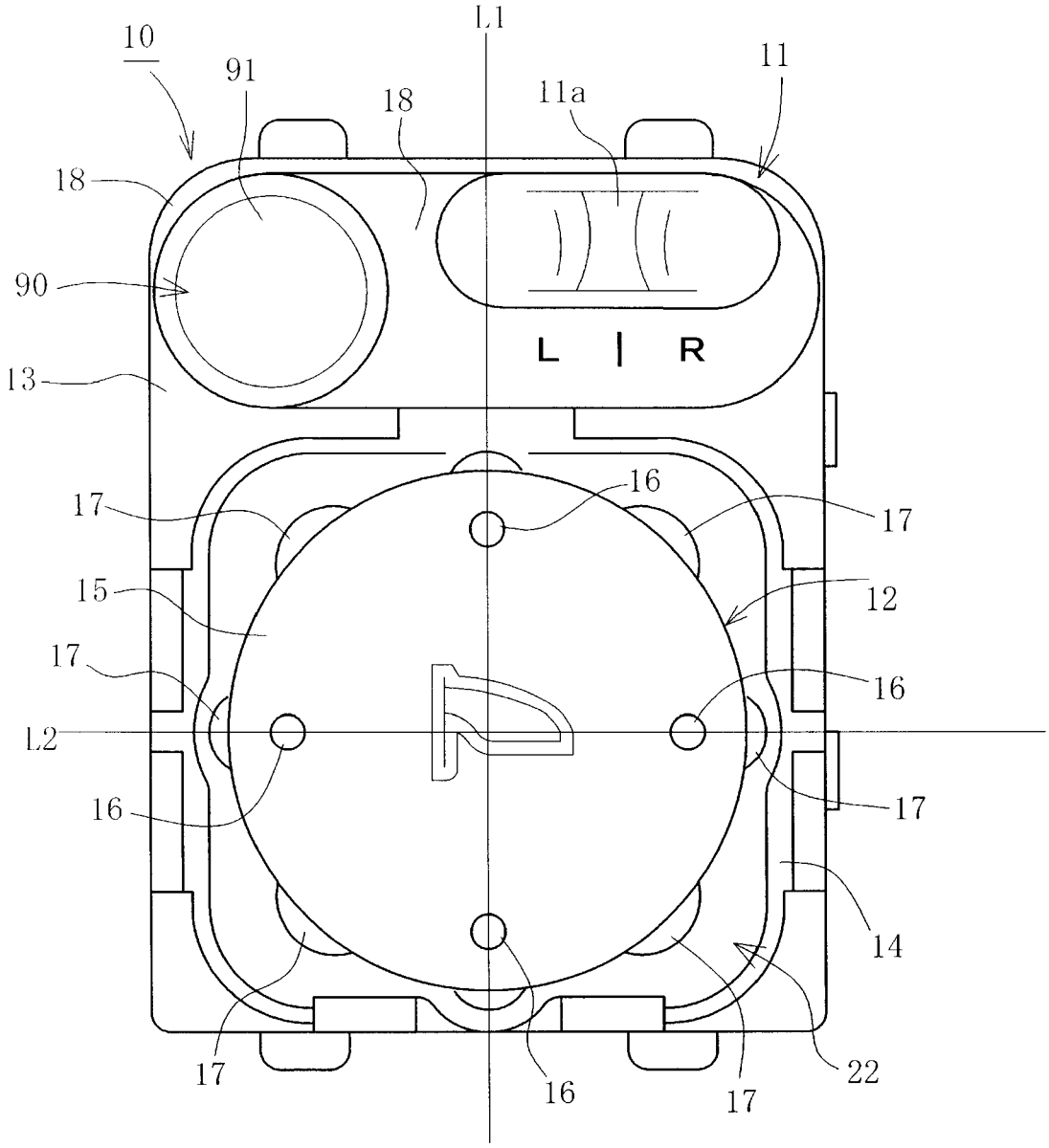
FIG. 18 is a plan view of a mirror switch according to a second embodiment of the present invention.
Figure 19:
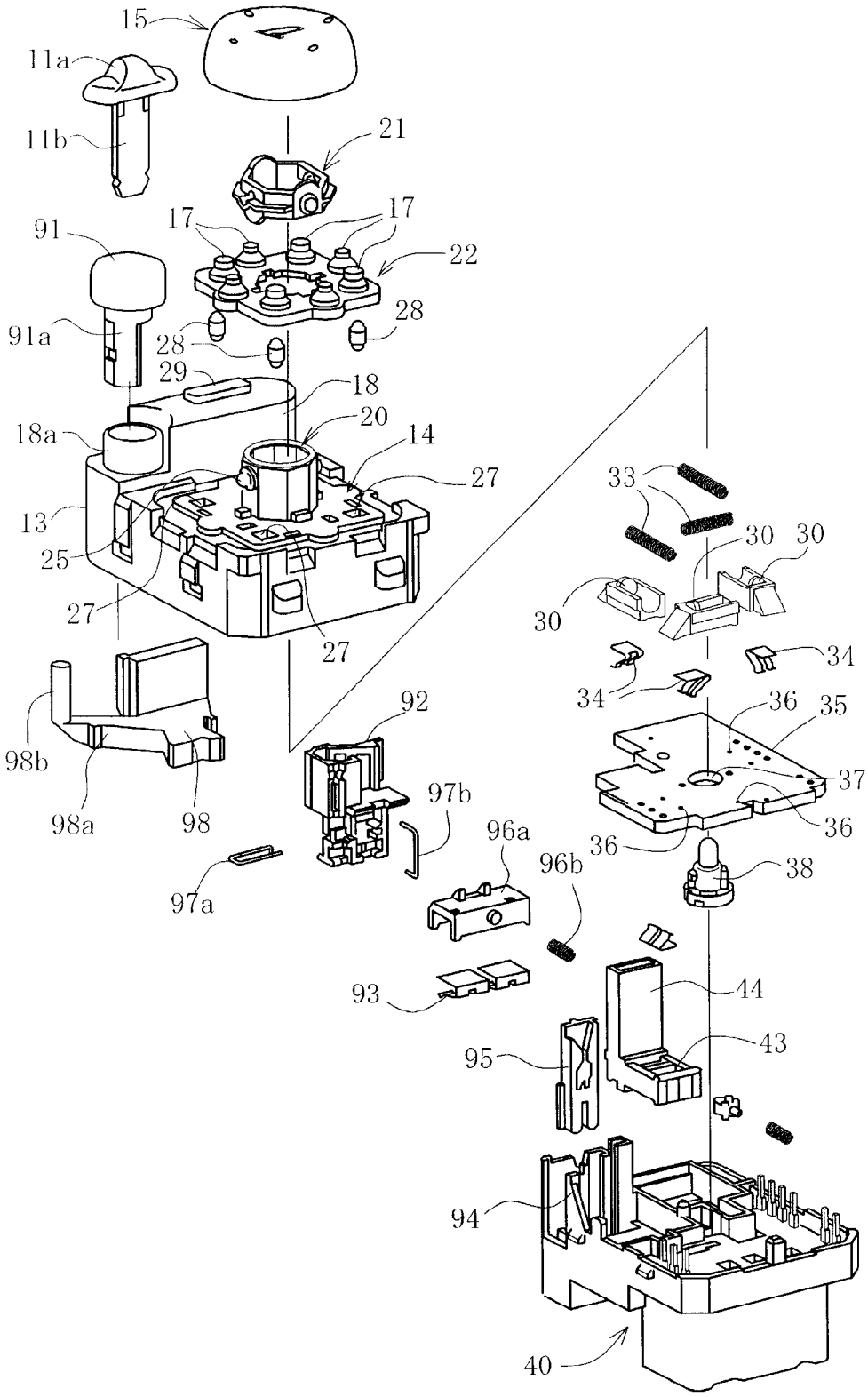
FIG. 19 is an exploded view thereof.
Figure 20:
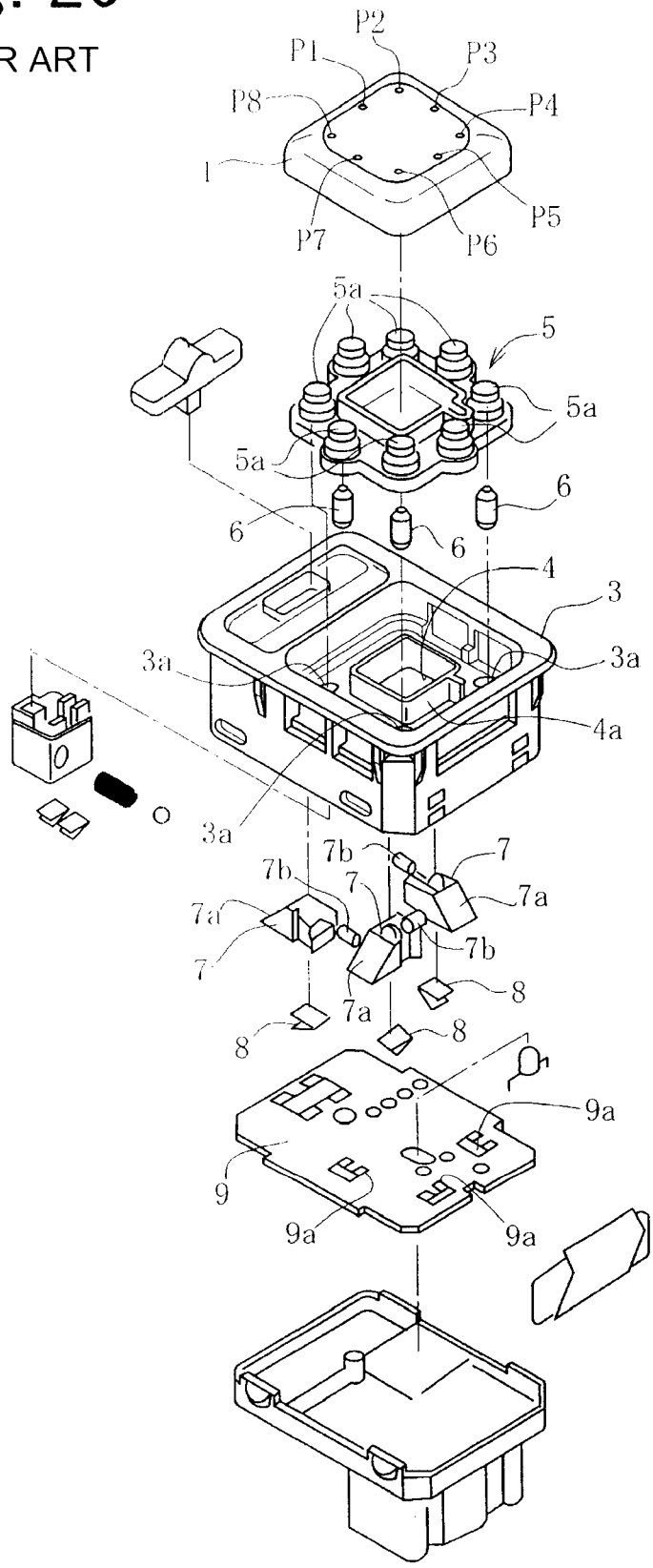
Fig. 20 PRIOR ART
FIG. 20 is an exploded view of the essential part of a conventional mirror switch.
Figure 21A:
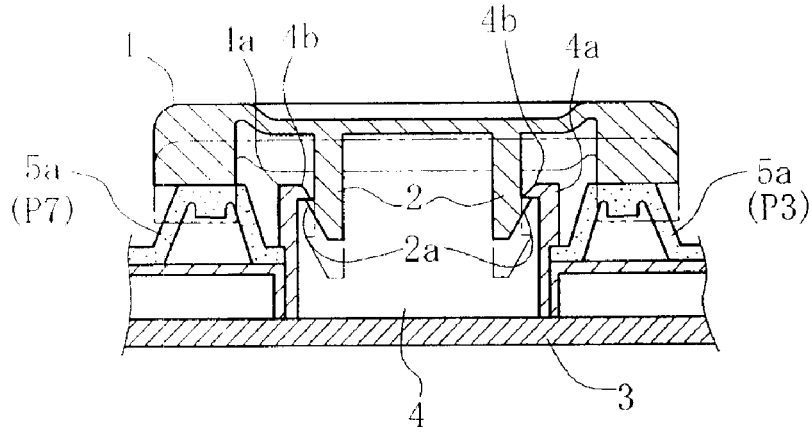
FIG. 21A PRIOR ART
FIGS. 21A-21C are schematic views showing various operating positions of the mirror switch of FIG. 20.
Figure 21B:
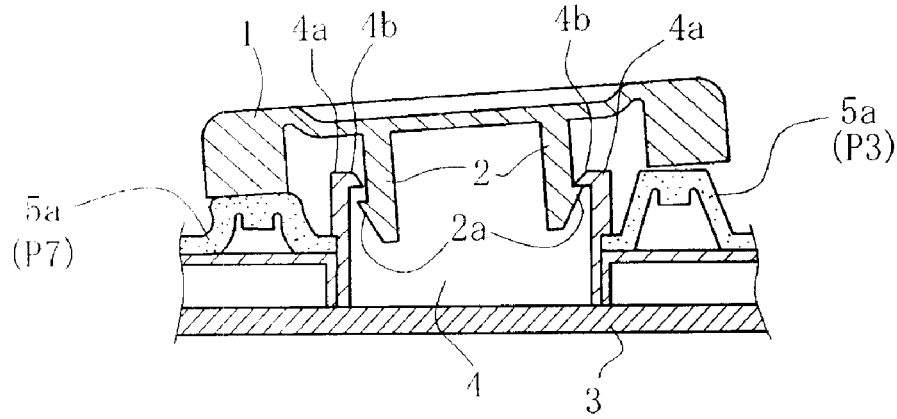
FIG. 21B PRIOR ART
Figure 21C:
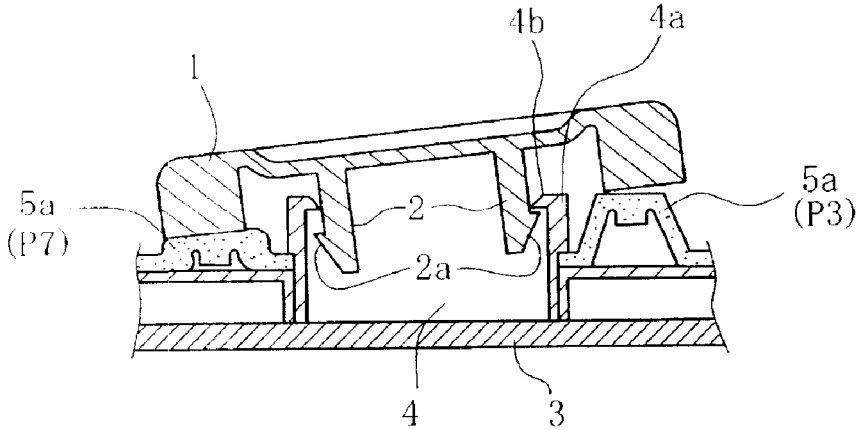
FIG. 21C PRIOR ART

FIG. 18 and FIG. 19 show a second embodiment, wherein FIG. 18 is a plan view of a switch and FIG. 19 is an exploded perspective view thereof. In this embodiment, only a retraction control switch of an electric mirror is added in comparison with the preceding embodiment. Therefore, like parts are given like reference characters, and the repeated explanation is avoided.

In this embodiment, a retraction control switch 90 is provided alongside of a concave portion 14. The retraction control switch 90 has a knob 91 a stem portion 19*a* of which is inserted into a cylinder 18*a* provided in a step section 18 so as to move a slider 92. The slider 92 has click pins 97*a* and 97*b* and is slidable on a support portion 94 provided on a lower case 40. Also, a push-push operation is carried out through a cam member 95.

The reference character 96*a* denotes a contact holder having a movable contact 93, the reference character 96*b* denoting a return spring, and the reference characters 97*a*, 97*b* denoting the click pins for anchoring the slider 92. The reference character 98 denotes a photo conductive member. The photo conductive member has a horizontal section and vertical section similar to the photo conductive member 47 and is further provided with a branched portion 98*a* on a tip of which is provided an upright portion 98*b*. The upright portion is inserted into the lower portion of the cylinder 18*a* so as to carry out the transmitted light display. Similar to the preceding embodiment, the main body portion of the photo conductive member is also adapted to carry out the transmitted light display for a slide switch 11.

This retraction control switch 90 employs a push-push switch mechanism. When pushing the knob 91 down, a motor (not shown) for operating extension and retraction, which is provided in the electric mirror, is operated in the normal direction of rotation so as to allow the electric mirror to be retracted to the accommodation position thereof. When next pushing the same, the extension and retraction operating motor is operated in the reverse direction of rotation so as to allow the mirror to be extended to the use position thereof.

Figure 22:
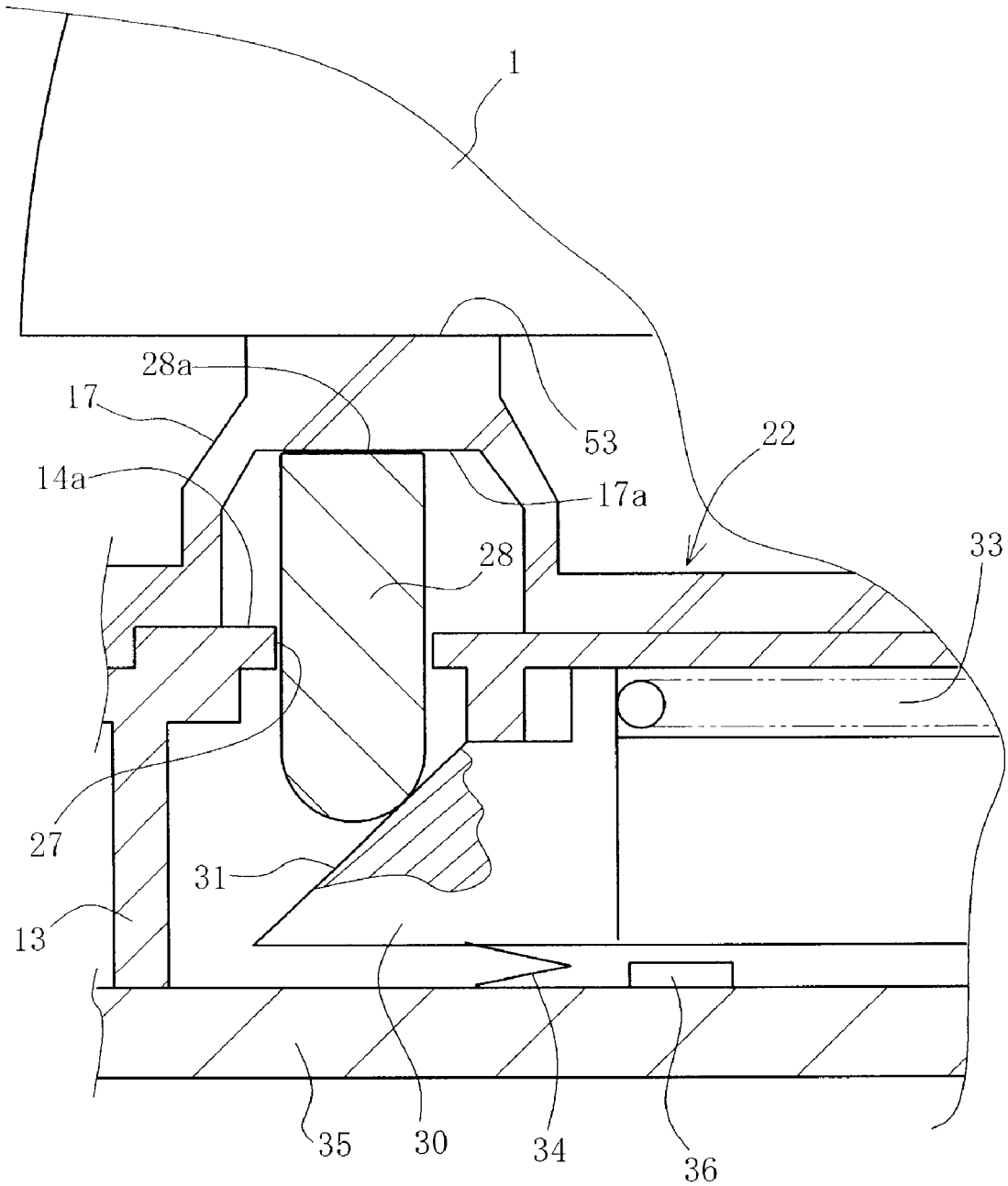
FIG. 22 is a view similar to FIG. 16 according to a third embodiment of the present invention.

FIG. 22 shows a third embodiment concerning the construction of the switch element and corresponds to a partial modification of FIG. 16. Therefore, like parts are given like reference characters. In this embodiment, also a part corresponding to a press point 4 is illustrated. An upper potion of an actuator rod 28 located inside of a lift spring 17 is formed with a flat wall 28*a*. The whole flat wall 28*a* comes into contact with a flat abutment portion 17*a* of the lift spring 17. This embodiment is different in construction from FIG. 16 only in this portion, and the rest is the same as FIG. 16.

Like this, when the flat wall 28*a* of the top of the actuator rod 28 contacts between flat surfaces with the abutment portion 17*a* of the lift spring 17, the response of the switch is improved and a blind spot in the switch operation range is decreased. Namely, if the top of the actuator rod 28 is formed with a curved surface, it contacts in a point contact state with the flat abutment portion 17*a* of the lift spring 17. Accordingly, when the lift spring 17 is pressed downward, a portion of the lift spring 17 contacted by the actuator rod 28 starts being elastically deformed at first and, after being elastically deformed sufficiently, pushes the actuator rod 28 down. Therefore, useless elastic deformation is caused in the switching operation, so that the response to the switching operation is delayed by the useless elastic deformation.

On the contrary, when the flat wall 28*a* of the top of the actuator rod 28 contacts between flat surfaces with the abutment portion 17*a* of the lift spring 17, the actuator rod 28 is immediately pushed down without such useless elastic deformation, so that the response of the switch is improved that much.

Further, in the case where the top of the actuator rod 28 contacts in the point contact state with the abutment portion 17*a* of the lift spring 17 as described above, the actuator rod 28 is pushed down when the lift spring 17 is pressed at this point contact portion, while the actuator rod 28 is inclined and keeps itself in the state that it is not pushed down, before being pushed down, when the lift spring 17 is pressed at a location off the point contact portion. Therefore, at the beginning of pressing the actuator rod 28, there is created the blind spot where no response to the switching operation occurs, depending upon the press spot.

On the contrary, in the case where the flat wall 28*a* of the top of the actuator rod 28 contacts between flat surfaces with the flat abutment portion 17*a* of the lift spring 17, such blind spot is not created and the actuator rod 28 is capable of being assuredly pushed down when the top of the actuator rod 28 is pushed, whereby the blind spot at the time of operation can be eliminated.

While the invention has been described in its preferred embodiments, it is to be understood that the present invention is not limited thereto but may be otherwise variously modified and applied within the scope and spirit of the invention. For example, the switch apparatus of the present invention is not limited to the mirror switch but is applicable to various kinds of switches that the operation knob is rocked in the optional directions. Also, the number of the press points is not limited to eight but may be increased. According to this, when the number of full dummy press points is increased, the interlocking press sections may be increased. Further, various kinds of publicly known construction may be employed as the switch element. There may be employed publicly known tact switch, for example.

What is claimed is:

1. A switch apparatus comprising a switch case being provided with a circuit board, an operation knob being mounted rockable in an optional direction relative to said switch case, a plurality of lift springs being arranged along a peripheral edge of the operation knob between the operation knob and the switch case to lift and support said operation knob a side of said switch case and being selectively compressed by a rocking movement of said operation knob, a plurality of switch elements which are smaller in number than the lift springs, being arranged in locations corresponding to said lift springs and provided on the circuit board, said switch elements being selectively pushed in accordance with the rocking direction of said operation knob, a joint member in the shape of a ring located between said operation knob and said switch case, said operation knob is so mounted on said joint member as to be rockable around a first axis of rocking movement, said joint member is so mounted on a knob mounting section provided on said switch case as to be rockable around a second axis of rocking movement meeting at right angles with the first axis of rocking movement, in such a manner that said operation knob is universally jointed through said joint member with said switch case, and an interlocking press section, wherein when said lift spring to which said switch element is not arranged correspondingly is pressed by said operation knob, said interlocking press section is adapted to push said switch element arranged correspondingly to another lift spring.

2. The switch apparatus according to claim 1, further comprising a first rocking pivot integrally projecting from said joint member on the first axis of rocking movement, wherein a distal end of said first rocking pivot is formed with a tapered wall for facilitating engagement between said first rocking pivot and said operation knob.

3. The switch apparatus according to claim 2, further comprising a second rocking pivot integrally projecting from said knob mounting section of said switch case on the second axis of rocking movement, wherein a distal end of said second rocking pivot is formed with a tapered wall for facilitating engagement between said second rocking pivot and said joint member.

4. The switch apparatus according to claim 3, wherein said knob mounting section is formed in a cylindrical shape, within an inner space of which a light bulb for a transmitted light display on said operation knob is arranged, said switch elements are provided in said switch case to surround said light bulb, and a photo conductive member is provided in said switch case by using a space in which said switch element is not arranged and conducts a light from said light bulb to a peripheral area of said switch case.

5. The switch apparatus according to claim 2, wherein said knob mounting section is formed in a cylindrical shape, within an inner space of which a light bulb for a transmitted light display on said operation knob is arranged, said switch elements is provided in said switch case to surround said light bulb, and a photo conductive member is provided in said switch case by using a space in which said switch element is not arranged and conducts a light from said light bulb to a peripheral area of said switch case.

6. The switch apparatus according to claim 1, wherein said knob mounting section is formed in a cylindrical shape, within an inner space of which a light bulb for a transmitted light display on said operation knob is arranged, said switch elements are provided in said switch case to surround said light bulb, and a photo conductive member is provided in said switch case by using a space in which said switch element is not arranged and conducts a light from said light bulb to a peripheral area of said switch case.

* * * * *